US009595753B2

(12) United States Patent
Hirose

(10) Patent No.: US 9,595,753 B2
(45) Date of Patent: Mar. 14, 2017

(54) ANTENNA ARRANGEMENT STRUCTURE FOR VEHICLE COMMUNICATION APPARATUS

(75) Inventor: Motohisa Hirose, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 207 days.

(21) Appl. No.: 14/407,577

(22) PCT Filed: Jun. 13, 2012

(86) PCT No.: PCT/JP2012/065136
§ 371 (c)(1),
(2), (4) Date: Feb. 27, 2015

(87) PCT Pub. No.: WO2013/186877
PCT Pub. Date: Dec. 19, 2013

(65) Prior Publication Data
US 2015/0171510 A1 Jun. 18, 2015

(51) Int. Cl.
*H01Q 1/32* (2006.01)
*H01Q 13/20* (2006.01)

(52) U.S. Cl.
CPC ..... *H01Q 1/3283* (2013.01); *H01Q 1/3241* (2013.01); *H01Q 1/3291* (2013.01); *H01Q 13/20* (2013.01); *H01Q 13/203* (2013.01)

(58) Field of Classification Search
CPC ..... H01Q 1/3291; H01Q 1/3283
USPC ..... 343/711, 713
See application file for complete search history.

(56) References Cited

FOREIGN PATENT DOCUMENTS

| | | |
|---|---|---|
| JP | 2002-359565 | 12/2002 |
| JP | 2007-318540 | 12/2007 |
| JP | 2011-146909 | 7/2011 |

OTHER PUBLICATIONS

International Search Report, Date of mailing: Aug. 21, 2012 (Aug. 21, 2012).

*Primary Examiner* — Dieu H Duong
(74) *Attorney, Agent, or Firm* — Rankin, Hill & Clark LLP

(57) ABSTRACT

An interior antenna of a vehicle communication apparatus for performing wireless communication with a portable terminal device present inside a cabin is disposed in the cabin. The interior antenna includes left and right leaky coaxial cables that can transmit high-frequency band radio waves into the cabin. The left and right leaky coaxial cables are positioned under the cabin and inside left and right door inner panels in a vehicle with direction, either above left and right side sills or at end portions in the vehicle width direction above a floor panel, and extend in a vehicle front-rear direction.

12 Claims, 17 Drawing Sheets

ANTENNA ARRANGEMENT STRUCTURE FOR VEHICLE COMMUNICATION APPARATUS

TECHNICAL FIELD

The present invention relates to a vehicle communication apparatus having an antenna arranged inside a vehicle interior in order to execute radio communication with a portable terminal device existing inside the vehicle interior. The present invention particularly relates to an antenna arrangement structure in which a radio wave of a high-frequency zone transmitted from the antenna can be prevented from leaking outside a vehicle from the vehicle interior. According to the present invention, the high-frequency zone means a frequency having at least 150 MHz.

BACKGROUND ART

A radio communication system built in a vehicle is a system in which an antenna to execute radio communication with a portable terminal device is arranged inside the vehicle interior, such as a vehicle electronic key system. The vehicle electronic key system is a system in which locking and unlocking a door of the vehicle is executed by radio communication using a portable electronic key without using a mechanical key, and generally the system is referred to as smart entry system. The electronic key is a portable terminal device including an authentication function, namely, a kind of key fob. The vehicle electronic key system detects whether the electronic key exists inside the vehicle interior by using a radio wave of a low frequency zone having a frequency of 125 kHz.

A reason for adopting the low frequency zone for the vehicle electronic key system is as follows. Generally, a radio wave is known to have a characteristic of being reflected by a mesh made of conductors (mesh) having an opening size which is 1/10 or less of a wavelength of the radio wave. The vehicle electronic key system utilizes this characteristic. More specifically, the wavelength of the radio wave of the low frequency zone is 2000 m or more. The radio wave of the low frequency zone is reflected by the mesh made of the conductors having a size of 2-meter squares (height 2 m×width 2 m) or less.

A standard vehicle has a window having a size smaller than 2-meter squares. The window can be regarded as the opening of 2-meter squares, namely, the mesh made of the conductors. The radio wave of the low frequency zone transmitted from an antenna arranged inside the vehicle interior does not leak outside the vehicle from the window having the size of about 1-meter to 2-meter squares. Thus, in the case where the radio wave of the low frequency zone is transmitted from the vehicle interior, the vehicle can be regarded as a metallic box (made of the conductors). The radio wave of the low frequency zone repeats being reflected inside the vehicle interior.

The vehicle electronic key system utilizing this characteristic transmits the radio wave of the low frequency zone from the antenna arranged inside the vehicle interior and detects a portable electronic key in the case of locking the door with a lock switch while the portable electronic key is left inside the vehicle interior. In the case where any response is received from the portable electronic key, existence of the portable electronic key inside the vehicle interior can be detected. Therefore, the door is never locked with the portable electronic key left inside the vehicle interior.

Considering portability for a driver, preferably, the portable electronic key is downsized as compact as possible. However, there is a limit to downsize the antenna included in the portable electronic key because the low frequency zone is adopted. Therefore, the inventor of the present invention focuses on a fact that various kinds of portable terminal devices including cell phones and portable information terminal devices (smartphones) are widely used in recent years. In the case where the portable terminal device can be used instead of the portable electronic key, it would be extremely convenient for a vehicle driver. For that, it is only necessary to incorporate the function of the portable electronic key only into the portable terminal device.

However, additionally making a space for mounting the antenna for the low frequency zone in a general portable terminal device is disadvantageous to improve versatility and merchantability of the portable terminal device and reduce the cost. Here, there are many cases in which communication systems based on the standards of Bluetooth (registered trademark) or Wi-Fi (registered trademark) is adopted in a general portable terminal device as standard for short-distance communication other than communication with a base station of a public network. Therefore, from the viewpoints of the cost and versatility, preferably, the communication based on the standards of Bluetooth (registered trademark) or Wi-Fi (registered trademark) is also adopted in the communication system of the portable terminal device including the function of portable electronic key.

However, according to the standards of Bluetooth (registered trademark) or Wi-Fi (registered trademark), a radio wave of a high-frequency zone having a frequency 2.4 GHz is used. A wavelength of the radio wave having the frequency 2.4 GHz is about 12.5 cm, which is extremely short.

According to the above-described relation between the wavelength of the radio wave and reflection of the radio wave, the wavelength is short in the case of adopting the frequency 2.4 GHz. Most of the radio waves are not reflected by the window of the vehicle and directly leak outside the vehicle from the window. In such a state, existence of the portable terminal device inside the vehicle interior cannot be detected even though the radio wave is transmitted from the antenna arranged inside the vehicle interior while the portable terminal device is left inside vehicle.

In recent years, development is made on a vehicle radio communication system in which control signal communication is executed over the radio among a plurality of devices mounted on the vehicle. This kind of vehicle radio communication system is known by Patent Literature 1.

The vehicle radio communication system known by Patent Literature 1 includes: one base station provided with a first antenna and a leaky coaxial cable (LCX); and a plurality of terminal stations configured to communicate with the base station over the radio.

The leaky coaxial cable is installed in an area inside the vehicle where a signal from the first antenna does not directly reach, and functions as a second antenna. A part of terminal stations among the plurality of terminal stations, positioned in the area where the signal from the first antenna cannot directly reach, receives a signal from the leaky coaxial cable.

However, the radio wave of the high-frequency zone transmitted from the leaky coaxial cable leaks outside the vehicle from the window only by simply arranging the leaky coaxial cable in the area where the signal from the first antenna cannot directly reach inside the vehicle. Since the radio wave of the high-frequency zone leaks outside the vehicle from the window even though such a leaky coaxial cable is adopted, for example, as an antenna of the above-described vehicle electronic key system, existence of the portable terminal device inside the vehicle interior cannot be detected.

PRIOR ART LITERATURE

Patent Literature

Patent Literature 1: JP 2007-318540 A

SUMMARY OF INVENTION

Technical Problem

An object of the present invention is to provide a technology whereby a radio wave of a high-frequency zone transmitted from an antenna arranged inside a vehicle interior can be prevented from leaking outside a vehicle from the vehicle interior.

Solution to Problem

According to the invention related to claim 1, provided is an antenna arrangement structure for a vehicle communication apparatus, in which interior antennas are arranged inside a vehicle interior surrounded by a vehicle body including right and left side sills formed of material reflecting an electromagnetic wave and extending in a longitudinal direction of the vehicle body, a floor panel laid between the right and left side sills, and respective door inner panels of right and left doors positioned in a vicinity of the right and left side sills, and the interior antennas can communicate with a portable terminal device existing inside the vehicle interior over radio. In the antenna arrangement structure, the interior antennas include right and left leaky coaxial cables capable of transmitting, to inside of the vehicle interior, a radio wave of a high-frequency zone having at least a frequency of 150 MHz generated by a signal generator, and the right and left leaky coaxial cables are positioned, on a more inner side in the vehicle width direction than the right and left door inner panels, either at a lower portion of the vehicle interior and above the right and left side sills, or at a lower portion of the vehicle interior and above both end portions in a vehicle width direction of the floor panel, and extend in a vehicle width direction.

As recited in claim 2, preferably, the right and left leaky coaxial cables are covered with side sill covers to cover at least a part of the right and left side sills and the floor panel.

As recited in claim 3, more preferably, right and left corrugated tubes covered with the right and left side sill covers are further provided. In the right and left corrugated tubes, the right and left leaky coaxial cables are passed through together with a wire harness connected to an on-vehicle device, and the right and left leaky coaxial cables are positioned closer to the vehicle interior side than the wire harness is, inside the right and left corrugated tubes.

As recited in claim 4, more preferably, the right and left leaky coaxial cables include a plurality of slots configured to pass the radio wave, and the plurality of slots is oriented in a vehicle outside direction which is an opposite direction of the vehicle interior.

As recited in claim 5, more preferably, connecting ends of the right and left leaky coaxial cables, configured to be connected to the signal generator, are positioned at a front portion of a vehicle.

As recited in claim 6, more preferably, a part of the plurality of slots, positioned at the front portion of the vehicle, is covered with a grounded conductor.

As recited in claim 7, more preferably, the right and left leaky coaxial cables are positioned on the more inner side in the vehicle width direction than the right and left side sills.

As recited in claim 8, more preferably, the right and left leaky coaxial cables pierce right and left center pillar erected from a approximately center in the longitudinal direction of the vehicle body of the right and left side sills.

As recited in claim 9, more preferably, the right and left leaky coaxial cables are positioned to stretch at least from front ends to rear ends of lower edges in respective right and left door openings configured to be opened and closed by the right and left doors.

As recited in claim 10, more preferably, the right and left leaky coaxial cables are positioned at least between the right and left door inner panels and right and left door linings coating inner surfaces in the vehicle width direction of the right and left door inner panels.

Advantageous Effects of Invention

According to the invention related to claim 1, the right and left leaky coaxial cables for constituting the interior antenna are positioned either above the right and left side sills or above both end portions in a vehicle width direction of the floor panel, at a lower portion of the vehicle interior and on a more inner side in the vehicle width direction than the right and left door inner panels. In other words, the right and left leaky coaxial cables are positioned at a lower left corner and a lower right corner of the vehicle interior, and also extend in the vehicle longitudinal direction. Wall surfaces of the respective lower corners are formed of material that reflects an electromagnetic wave. When radio waves of the high-frequency zone transmitted inside the vehicle interior from the right and left leaky coaxial cables hit the lower right and left corners of the vehicle interior, the radio waves are reflected by the wall surfaces of the respective lower corners and returned to the vehicle interior. A distance from the right and left leaky coaxial cables to a window that easily passes the electromagnetic wave is relatively long.

Further, the radio waves can be prevented from passing the window and leaking outside the vehicle from the vehicle interior by suitably adjusting (e.g., adjustment by an output adjuster) transmission output of the radio waves of the high-frequency zone transmitted from the right and left leaky coaxial cables. In other words, even in the case of using the radio waves of the high-frequency zone for the vehicle communication apparatus, a transmission range of the radio waves can be adjusted so as to be only within the vehicle interior just by adjusting the transmission output of the radio waves. For instance, it is possible to build a vehicle electronic key system using the communication system based on the standards of Bluetooth (registered trademark) or Wi-Fi (registered trademark) loaded on the portable terminal device as standard. Thus, for the communication system of the vehicle communication apparatus, the communication system with higher versatility based on the standards of Bluetooth (registered trademark) or Wi-Fi (registered trademark) adopted as standard in the portable terminal device can be applied.

According to the invention related to claim 2, the leaky coaxial cable is covered with the side sill cover to cover at least a part of side sill and the floor panel. Therefore, the leaky coaxial cable can be arranged in an appropriate place in view of controlling the communication range. Moreover, since the leaky coaxial cable is covered with the side sill cover, the leaky coaxial cable cannot be directly seen by a passenger. Therefore, appearance property of the vehicle interior can be improved. Further, the leaky coaxial cable is passed through by effectively utilizing an internal space of the side sill cover. It is not necessary to provide any new space in the vehicle interior in order to pass the leaky coaxial cable. Therefore, the space equal to the related art can be secured in the vehicle interior.

According to the invention related to claim 3, the leaky coaxial cable is passed through the corrugated tube by effectively using the corrugated tube through which the wire harness is passed. With this structure, the leaky coaxial cable can be protected without using any new protection member. Moreover, generation of friction and abnormal sound caused by the leaky coaxial cable contacting other members due to vibration of the vehicle can be prevented. Furthermore, inside the corrugated tube, the leaky coaxial cable is positioned closer to vehicle interior than the wire harness. With this structure, desired communication performance can be obtained without a signal being interrupted by the wire harness despite a fact that the corrugated tube is passed through the corrugated tube together with the wire harness.

According to the invention related to claim 4, the plurality of slots provided at the leaky coaxial cable is oriented in the vehicle outside direction which is the opposite direction of the vehicle interior. With this structure, the signal is reflected and diffused by the member reflecting the radio wave inside the vehicle body. Therefore, an electric field radiated inside the vehicle interior can be homogenized.

According to the invention related to claim 5, the connecting ends (signal input ends) inside the right and left leaky coaxial cables and to be connected to the signal generator are positioned at the front portion of the vehicle. Generally, the leaky coaxial cables have electric field strength which tends to be stronger as the position becomes closer to the signal input ends (connecting ends). The connecting ends are connected to the signal generator at the front portion of the vehicle, thereby achieving to improve reliability of communication particularly in an area of a front seat where a driver is seated. In many cases, the portable terminal device is carried by the driver, including a case where only the driver is in the vehicle. Therefore, reliability of communication can be particularly improved for the driver who is seated on the front seat.

According to the invention related to claim 6, a part of the plurality of slots, positioned at the front portion of the vehicle, is covered with the grounded conductor. With this structure, the electric field strength can be homogenized between the front seat side and a rear seat side despite a fact that the connecting ends (signal input ends) of the leaky coaxial cables are positioned at the front portion of the vehicle. For example, detection accuracy in the case of detecting the portable terminal device left inside the vehicle interior can be homogenized in the entire vehicle interior.

According to the invention related to claim 7, the right and left leaky coaxial cables are positioned on a more inner side in the vehicle width direction than the right and left side sills. With this structure, the leaky coaxial cable extending in the longitudinal direction of the vehicle is not interrupted, for example, by the center pillar positioned substantially at the center in the longitudinal direction of the side sill. Therefore, the right and left leaky coaxial cables can be linearly extended from the front portion to the rear portion of the vehicle interior without bypassing the right and left center pillars. Also, the right and left leaky coaxial cables are not needed to be divided in the longitudinal direction of the vehicle interior.

According to the invention related to claim 8, the right and left leaky coaxial cables pierce the right and left center pillar in the longitudinal direction of the vehicle body. Therefore, the right and left leaky coaxial cables can be linearly extended from the front portion to the rear portion of the vehicle interior without bypassing the right and left center pillars. Also, the right and left leaky coaxial cables are not needed to be divided in the longitudinal direction of the vehicle interior.

According to the invention related to claim 9, the right and left leaky coaxial cables are positioned to stretch at least from the front ends to the rear ends of the lower edges of the respective right and left door openings. Since the right and left leaky coaxial cables are passed through by effectively utilizing the space at the lower edges of the right and left door openings, it is not necessary to provide any new space in the vehicle interior in order to pass the leaky coaxial cables. Therefore, the space equivalent to the related art can be secured in the vehicle interior.

According to the invention related to claim 10, the right and left leaky coaxial cables are positioned at least between the right and left door inner panels and the right and left door linings coating the inner surfaces in the vehicle width direction of the right and left door inner panels. Since the right and left leaky coaxial cables are passed through by effectively utilizing the space between the right and left door inner panels and the right and left door linings, it is not necessary to provide any new space in the vehicle interior in order to pass the leaky coaxial cables. Therefore, the space equal to the related art can be secured in the vehicle interior.

DESCRIPTION OF EMBODIMENTS

Embodiments according to the present invention will be described below with reference to the accompanying drawings.

First Embodiment

Figure 1:
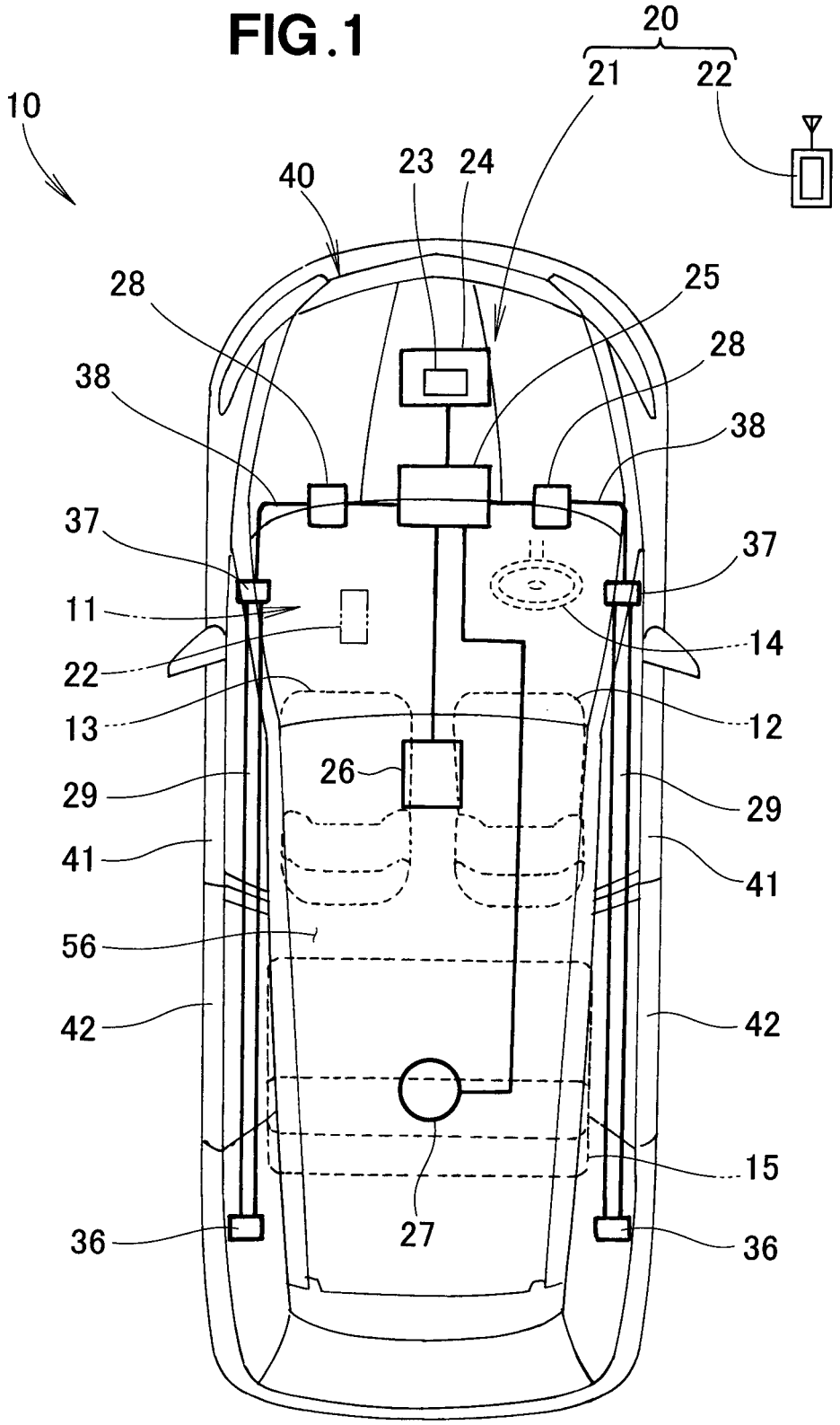
FIG. 1 is a plan view schematically illustrating a vehicle mounted with a vehicle communication apparatus according to a first embodiment of the present invention.

An antenna arrangement structure for a vehicle communication apparatus according to a first embodiment will be described based on FIGS. 1 to 9. As illustrated in FIG. 1, a vehicle communication apparatus 21 is mounted on a vehicle 10. The vehicle communication apparatus 21 can communicate with a portable terminal device 22 over radio. A vehicle electronic key system 20 is formed of the vehicle communication apparatus 21 and the portable terminal device 22, for example. The vehicle electronic key system 20 is a system in which locking and unlocking of doors 41, 41, 42, 42 of the vehicle 10 is executed by radio communication using the portable terminal device 22 without using a mechanical key, and the system is generally referred to as smart entry system.

The portable terminal device 22 is a kind of so-called key fob in which an authentication function is integrated, and includes a portable phone terminal device or a smart portable phone terminal device (smartphone). The portable terminal device 22 includes a function of a portable electronic key of the vehicle electronic key system 20. A communication system based on standards of Bluetooth (registered trademark) or Wi-Fi (registered trademark) is adopted for the communication system of the portable terminal device 22. According to the standards of Bluetooth (registered trademark) or Wi-Fi (registered trademark), a radio wave of a high-frequency zone having a frequency of 2.4 GHz is used.

The vehicle communication apparatus 21 includes a control unit 24 including a communication integrated circuit 23 to communicate with the portable terminal device 22, a signal distributor 25 configured to distribute a signal issued from the control unit 24, a near area antenna 26 and a wide area antenna 27 connected to the signal distributor 25, and two output adjusters 28, 28 configured to suitably adjust transmission output of the signal output from the signal distributor 25, and two leaky coaxial cables 29, 29 connected to the output adjusters 28, 28.

The control unit 24 is a so-called signal generator that generates a signal (radio wave) of plural kinds of frequencies. The communication integrated circuit 23 is formed of a Bluetooth (registered trademark) IC, for example, because the communication system based on the Bluetooth (registered trademark) is adopted. The control unit 24, signal distributor 25, and two output adjusters 28, 28 are positioned at a front portion of the vehicle 10, for example, inside of an instrument panel and an engine room. The signal distributor 25 sequentially switches a connected state among the near area antenna 26, wide area antenna 27, right leaky coaxial cable 29, and left leaky coaxial cable 29 with respect to the control unit 24 at a constant time interval.

Figure 2:
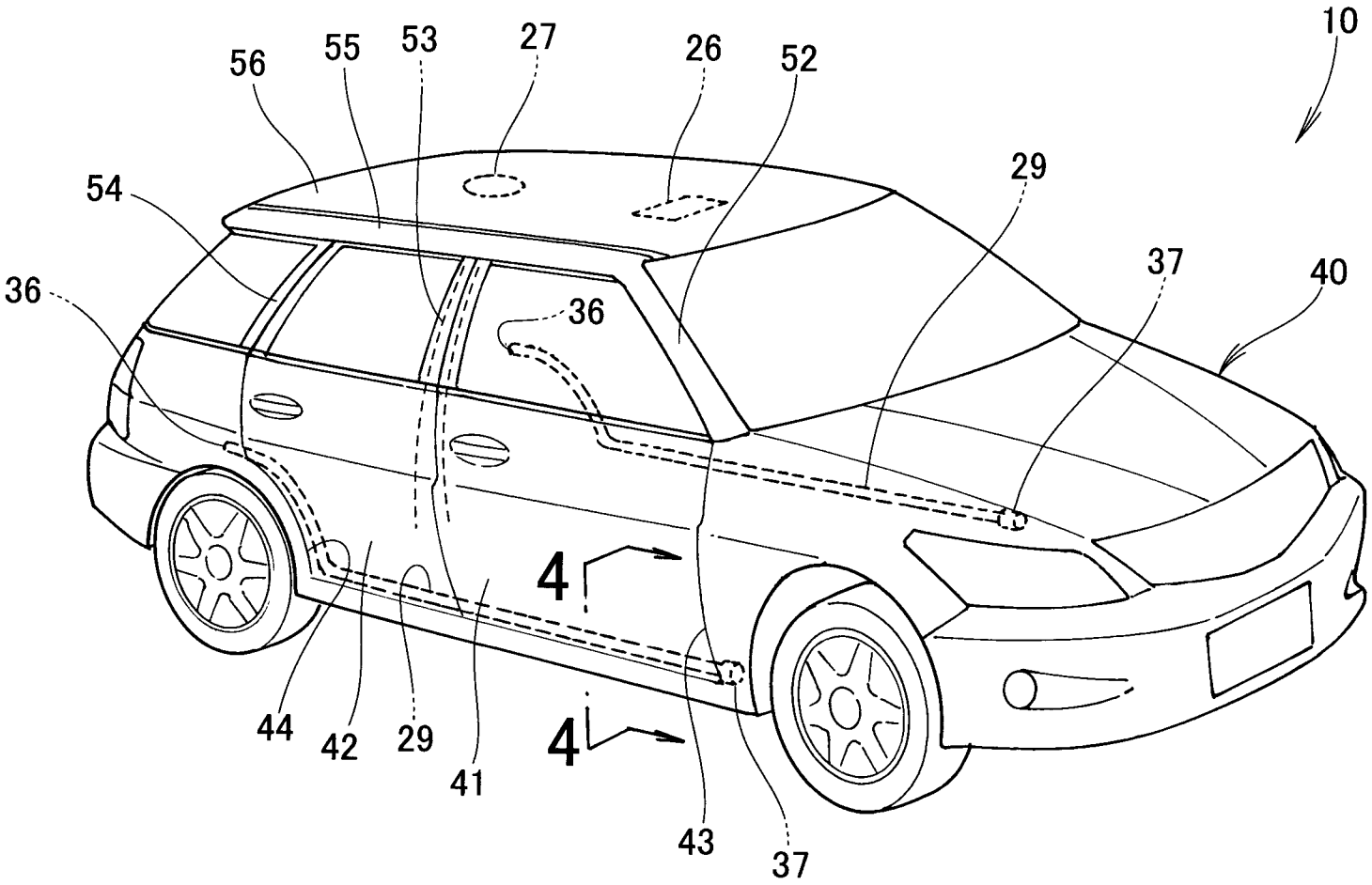
FIG. 2 is a perspective view illustrating the vehicle of FIG. 1.

As illustrated in FIGS. 1 and 2, the near area antenna 26 is an antenna of a communication area, which is capable of communicating with the portable terminal device 22 positioned near a periphery of the vehicle 10, and arranged at an inner surface of a roof 56 of the vehicle 10.

The wide area antenna 27 is an antenna of a communication area, which is capable of communicating with the portable terminal device 22 positioned in an outer periphery of a communication area of the near area antenna 26, and arranged at an outer surface of the roof 56 of the vehicle 10.

The two leaky coaxial cables 29, 29 constitute an interior antenna capable of communicating with the portable terminal device 22 existing inside a vehicle interior 11 over the radio. In other words, the two leaky coaxial cables 29, 29 can transmit, to the inside of the vehicle interior 11, a radio wave of the high-frequency zone having at least a frequency of 150 MHz (preferably 2.4 GHz) generated by the control unit 24 (signal generator 24). The two leaky coaxial cables 29, 29 are arranged at a lower portion of the vehicle interior 11, one in each of right and left sides. In other words, one leaky coaxial cable 29 is arranged on a driver's seat 12 side inside the vehicle interior 11 and extends in a vehicle longitudinal direction. The other leaky coaxial cable 29 is arranged on a front passenger seat 13 side inside the vehicle interior 11 and extends in the vehicle longitudinal direction.

The vehicle 10 is, for example, a so-called right-hand drive vehicle in which a steering wheel 14 positioned on the right side is steered. In the following, the description will be continued, exemplifying the right-hand drive vehicle. The leaky coaxial cable 29 arranged on the driver's seat 12 side will be conveniently referred to as "right leaky coaxial cable 29" in the following. The leaky coaxial cable 29 arranged on the front passenger seat 13 side will be conveniently referred to as "left leaky coaxial cable 29" in the following.

Figure 3:
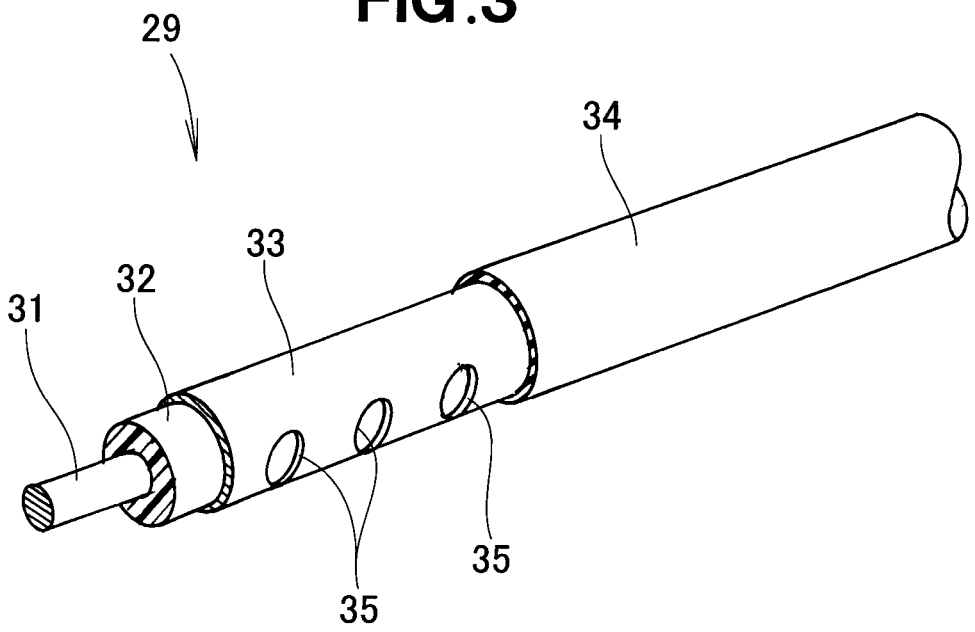
FIG. 3 is an explanatory view for explaining the arrangement of a leaky coaxial cable in the vehicle of FIG. 2.

As illustrated in FIG. 3, the right and left leaky coaxial cables 29, 29 are a kind of coaxial cable which can be freely bent and includes a central conductor 31 positioned at the center of the cable and configured to pass a communication signal (radio wave), an insulation film 32 having electrical insulation property and covering the central conductor 31, an outer conductor film 33 having conductivity and covering the insulation film 32, and a surface skin 34 covering the outer conductor film 33.

The outer conductor film 33 is provided with a plurality of small holes 35 (slots 35) arrayed in a line at predetermined intervals in a longitudinal direction of the cable. Through the plurality of slots 35, radio waves can pass, i.e., the radio waves can pass inward and outward in a radial direction of the cable. The above-described right and left leaky coaxial cables 29, 29 each have a structure similar to a so-called slot array antenna in which the plurality of slots 35 adjacent to one another mutually interacts with one another and functions as a transceiving antenna. A communication signal transmitted through the central conductor 31 is leaked outside from the plurality of slots 35 as the radio waves, thereby forming a communication area around the right and left leaky coaxial cables 29, 29.

A size of each slot 35, an interval between the slots 35, and the number of the slots 35 in a unit area of the cable (slot density) are set so as to be most suitable as the interior antenna. For instance, the larger the slot 35 size is or the larger the slot density is, the more radio waves are reflected from the right and left leaky coaxial cables 29, 29 to the vehicle interior 11.

As illustrated in FIGS. 1 and 2, the right and left leaky coaxial cables 29, 29 extend in the vehicle longitudinal direction and provided with terminating resistors 36, 36 at rear ends thereof. The rear ends of the right and left leaky coaxial cables 29, 29 are positioned at rear ends of the vehicle interior 11. Front ends 37, 37 of the right and left leaky coaxial cables 29, 29, namely, right and left connecting ends 37, 37 are positioned at the front portion of the vehicle 10, for example, front ends of the vehicle interior 11, inside the instrument panel, or the engine room. The right and left connecting ends 37, 37 are connected to the control unit 24 (signal generator 24) with communication lines 38, 38 via the two output adjusters 28, 28 and the signal distributor 25.

In the following, an outline of a vehicle body 40 of the vehicle 10 will be described. As illustrated in FIGS. 1 and 2, the vehicle 10 is a so-called four-door passenger vehicle including right and left front doors 41, 41 and right and left rear doors 42, 42 in the vehicle body 40, and the vehicle interior 11 is formed on the inner side of a center portion of the vehicle body 40. The vehicle body 40 is formed of a monocoque body, and also formed in a bilaterally symmetric shape with respect to a vehicle width center line that passes a center of the vehicle width direction of the vehicle 10 and extends in the vehicle longitudinal direction. The right and left front doors 41, 41 and the right and left rear doors 42, 42 are swing doors that open outward in the vehicle width direction.

Figure 4:
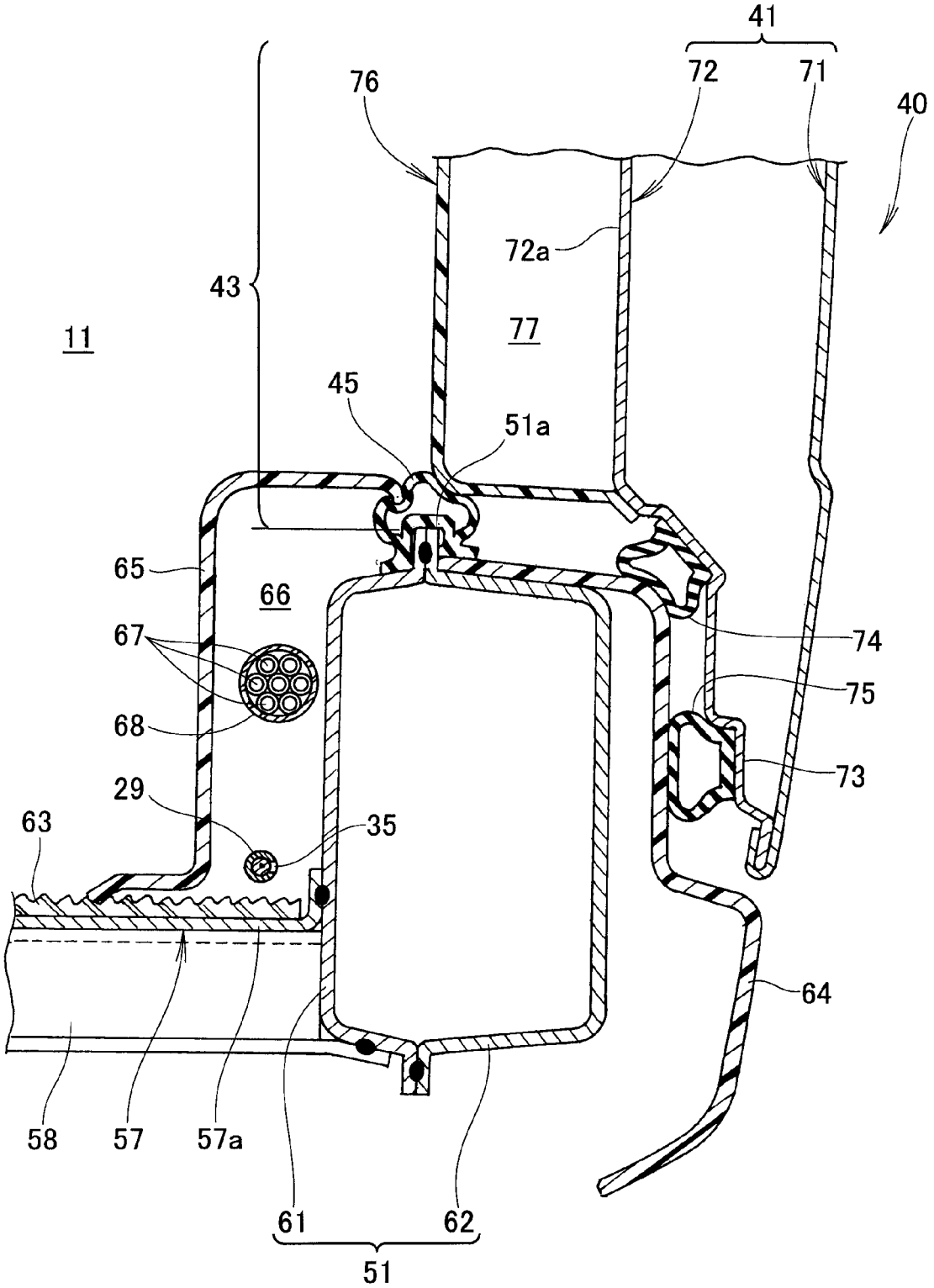
FIG. 4 is a cross-sectional view taken along line 4-4 of FIG. 2.
Figure 5:
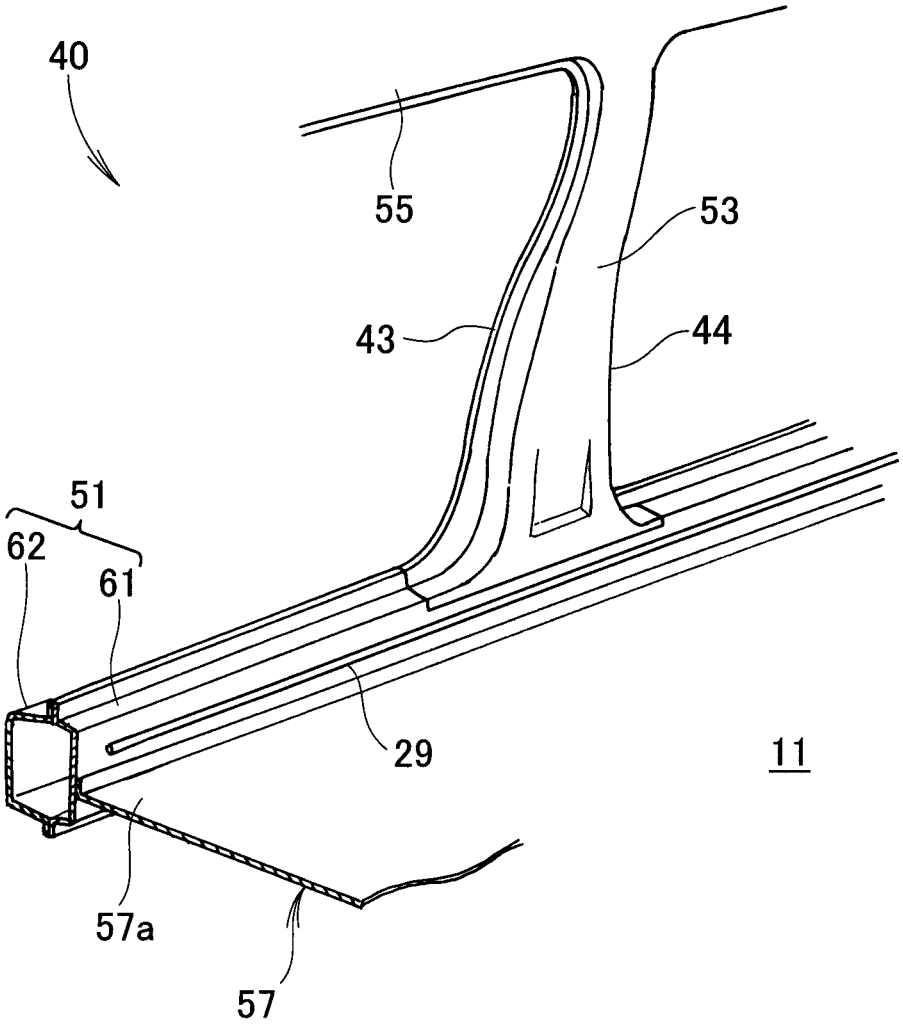
FIG. 5 is a perspective view illustrating a structure in which the leaky coaxial cable illustrated in FIG. 4 is passed inside the vehicle interior, viewed from the vehicle interior.

As illustrated in FIGS. 2, 4, and 5, the vehicle body 40 includes right and left side sills 51, right and left front pillars 52, right and left center pillars 53, right and left rear pillars 54, right and left roof rails 55, a roof 56, and a floor panel 57.

The right and left side sills 51 are positioned on right and left side portions at the lower portion in the center of the longitudinal direction of the vehicle body and extend in the longitudinal direction of the vehicle body 40. As illustrated in FIG. 4, the right and left side sills 51 are formed in a substantially rectangular closed cross-section shape uniformly in the longitudinal direction of the vehicle body 40. In other words, the side sill 51 is a closed cross-section body formed of: a side sill inner 61 positioned on an inner side in the vehicle width direction, and a side sill outer 62 positioned on an outer side in the vehicle width direction.

As illustrated in FIGS. 2 and 5, the right and left front pillars 52 extend upward from front end portions of the right and left side sills 51. The right and left center pillars 53 extend upward from a middle of the longitudinal direction of the right and left side sills 51. The right and left rear pillars 54 extend upward from rear end portions of the right and left side sills 51.

The right and left roof rails 55 are stretched between upper ends of the right and left front pillars 52, upper ends of the right and left center pillars 53, and upper ends of the right and left rear pillars 54. The roof 56 is stretched between the right and left roof rails 55.

As illustrated in FIGS. 4 and 5, the floor panel 57 is laid between the right and left side sills 51, and a floor carpet 63 is laid on an upper surface thereof. A lower surface of the floor panel 57 is supported by a cross member 58 stretched between the right and left side sills 51.

As illustrated in FIGS. 2 and 5, right and left door openings 43 positioned on the front side and right and left door openings 44 positioned on the rear side are formed on right and left side surfaces of the vehicle body 40.

The right and left door openings 43 positioned on the front side are opened and closed by the right and left front doors 41, 41, and surrounded by the right and left side sills 51, right and left front pillars 52, right and left center pillars 53, and right and left roof rails 55.

The right and left door openings 44 positioned on the rear side are opened and closed by the right and left rear doors 42, 42, and surrounded by the right and left side sills 51, right and left center pillars 53, right and left rear pillars 54, and right and left roof rails 55.

As illustrated in FIG. 4, lower-side edges of the right and left door openings 43 are formed of upper edges 51*a* of the right and left side sills 51. An opening sealing member 45 (door opening seal 45) is provided at an edge of each of the right and left door openings 43. The right and left side sills 51 have at least outer surfaces in the vehicle width direction covered with right and left side sill garnishes 64. The right and left side sill garnishes 64 are a kind of decorative cover to improve appearance property of the outer surfaces of the right and left side sills 51.

Further, the right and left side sills 51 and floor panel 57 each have at least a part covered with the right and left side sill covers 65. More specifically, the right and left side sill covers 65 each cover an inner-side surface in the vehicle width direction and an upper surface of the side sill 51 and an upper surface of an end portion in the vehicle width direction of the floor panel 57. A first space section 66 having a predetermined distance is provided between the inner-side surface in the vehicle width direction of each of the right and left side sills 51 and each of the right and left side sill covers 65.

The first space section 66 is surrounded by each of the right and left side sills 51, both end portions 57*a* in the vehicle width direction of the floor panel 57, and each of the right and left side sill covers 65, and passes through in the longitudinal direction of the vehicle body along each of the right and left side sills 51. In the first space section 66, a plurality of wire harnesses 67 connected to an on-vehicle device not illustrated is passed through. The plurality of wire harnesses 67 is protected by being collectively passed through a protection tube 68 such as a corrugated tube. In the following, the protection tube 68 is conveniently referred to as "corrugated tube 68".

The right and left front doors 41 are hollow members each including a door outer panel 71 on an outer side in the vehicle width direction and a door inner panel 72 on an inner side in the vehicle width direction. The right and left rear doors 42 (see FIG. 2) have the same structure as the right and left front door 41. A peripheral portion 73 of the door 41 is formed by connecting an edge of the door outer panel 71 to an edge of the door inner panel 72.

Sealing members 74, 75 for an inner and outer double door are provided at the peripheral portion 73 of the door 41.

The door sealing members 74, 75 are elastic members to contact and seal a sealing contact portion of the door opening 43, namely, each of right and left side sill garnishes 64, while the door opening 43 positioned on the front side is closed with the front door 41. While the door opening 43 is closed with the front door 41, the periphery of the door opening 43 is sealed with the door sealing members 74, 75.

An inner surface 72*a* in the vehicle width direction of the door inner panel 72 is covered with a door lining 76. A second space section 77 having a predetermined distance is formed between the door inner panel 72 and the door lining 76. The second space section 77 and each of the right and left door linings 76 are positioned straightly above each of the right and left side sills 51, and also overlaps with each of the right and left side sills 51 in the vehicle width direction.

As illustrated in FIGS. 2 and 4, the vehicle interior 11 is a space surrounded by the vehicle body 40 including at least the right and left side sills 51, floor panel 57, right and left doors 41, 41, 42, 42, and respective door inner panels 72. More specifically, the vehicle interior 11 is surrounded by the right and left side portions, floor panel 57, roof 56, right and left doors 41, 41, 42, 42, and a dashboard (not illustrated) of the vehicle body 40.

At least the respective members constituting the vehicle interior 11, for example, the right and left side portions (including the right and left side sills 51), roof 56, floor panel 57, right and left doors 41, 41, 42, 42, door outer panel 71, and door inner panel 72 of the vehicle body 40 are made of material that reflects an electromagnetic wave. The material that reflects the electromagnetic wave is, for example, aluminum material (including aluminum alloy). Further, the material that reflects the electromagnetic wave includes a press-molded product, a casting product, and a forged product of plate material.

In the following, arrangement of the right leaky coaxial cables 29 with respect to the vehicle body 40 will be described in detail. As for the arrangement structure of the left leaky coaxial cable 29, a description will be omitted for being same as the arrangement structure of the right leaky coaxial cable 29 except for being bilaterally symmetric.

As illustrated in FIGS. 4 and 5, the right leaky coaxial cable 29 (interior antenna 29) is arranged inside the vehicle interior 11. The right leaky coaxial cable 29 is positioned, on the more inner side in the vehicle width direction than the right and left door inner panels 72, at the lower portion of the vehicle interior 11 and above both end portions 57*a* in the vehicle width direction of the floor panel 57.

More specifically, the right leaky coaxial cable 29 is positioned at a corner between the side sill 51 and the end portion 57*a* of the floor panel 57. In other words, the leaky coaxial cable 29 is positioned on the more inner side in the vehicle width direction than the side sill 51 and also extends along the side sill 51 in the longitudinal direction. With this structure, the leaky coaxial cable 29 is not interrupted by the center pillar 53 positioned substantially at the center in the longitudinal direction of the side sill 51. Therefore, the leaky coaxial cable 29 is not needed to be divided in the longitudinal direction of the vehicle interior 11.

The right leaky coaxial cable 29 is passed through the inside of the first space section 66. As a result, the right leaky coaxial cable 29 is surrounded by the right side sill 51, the end portion 57*a* in the vehicle width direction of the floor panel 57, and the right side sill cover 65.

Thus, the leaky coaxial cable 29 is covered with the side sill cover 65. With this structure, the leaky coaxial cable 29 can be arranged in an appropriate place in the view of controlling the communication range. Further, since the leaky coaxial cable 29 is covered with the side sill cover 65, the leaky coaxial cable is invisible for a passenger. Therefore, appearance property of the vehicle interior 11 can be improved. Also, the leaky coaxial cable 29 is passed through by effectively utilizing the inner space 66 (first space section 66) of the side sill cover 65. It is not necessary to provide any new space in the vehicle interior 11 to pass the leaky coaxial cable 29. Therefore, the space equal to the related art can be secured in the vehicle interior 11.

As illustrated in FIG. 1, the connecting ends 37, 37 (signal input ends 37, 37) inside the right and left leaky coaxial cables 29, 29, which are connected to the signal generator 24, are positioned at the front portion of the vehicle 10. Generally, electric field strength of the leaky coaxial cables 29, 29 tends to be stronger at a position closer to the signal input ends 37, 37 (connecting ends 37, 37). The connecting ends 37, 37 are connected to the signal generator 24 at the front portion of the vehicle 10, thereby achieving to improve reliability of communication particularly in an area of the front seat 12 where a driver is seated. The portable terminal device 22 is mainly carried by the driver, including a case where only the driver is in the vehicle. Therefore, reliability of communication can be particularly improved for the driver being seated on the front seat 12.

Figure 6:
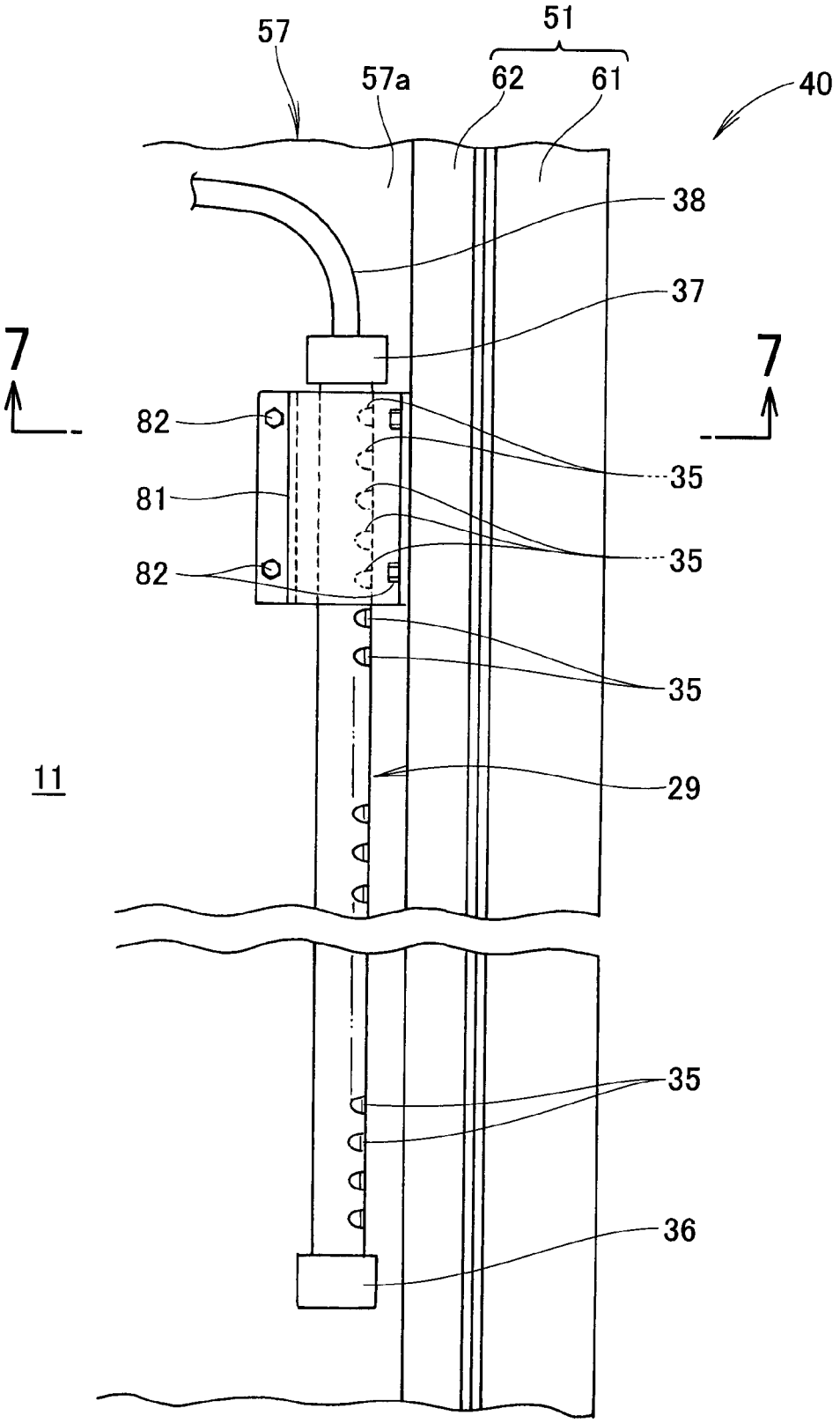
FIG. 6 is a plan view illustrating a structure in which a part of the leaky coaxial cable illustrated in FIG. 1 is covered with a conductor.

As illustrated in FIGS. 4 and 6, the plurality of slots 35 provided at the leaky coaxial cable 29 is oriented in a vehicle outside direction which is an opposite direction of the vehicle interior 11. For example, the plurality of slots 35 is oriented to both end portions 57*a* in the vehicle width direction of the floor panel 57 or the right and left side sills 51. With this structure, a signal is reflected and diffused by the member reflecting the radio wave inside the vehicle body 40. Therefore, an electric field radiated inside the vehicle interior 11 can be homogenized. Preferably, a distance between the reflecting member and the leaky coaxial cable 29 is short in order that the radio wave transmitted from the leaky coaxial cable 29 is effectively reflected by the member reflecting the radio wave (reflecting member) inside the vehicle body 40. The distance is set at 150 mm at a maximum, for example.

Figure 7:
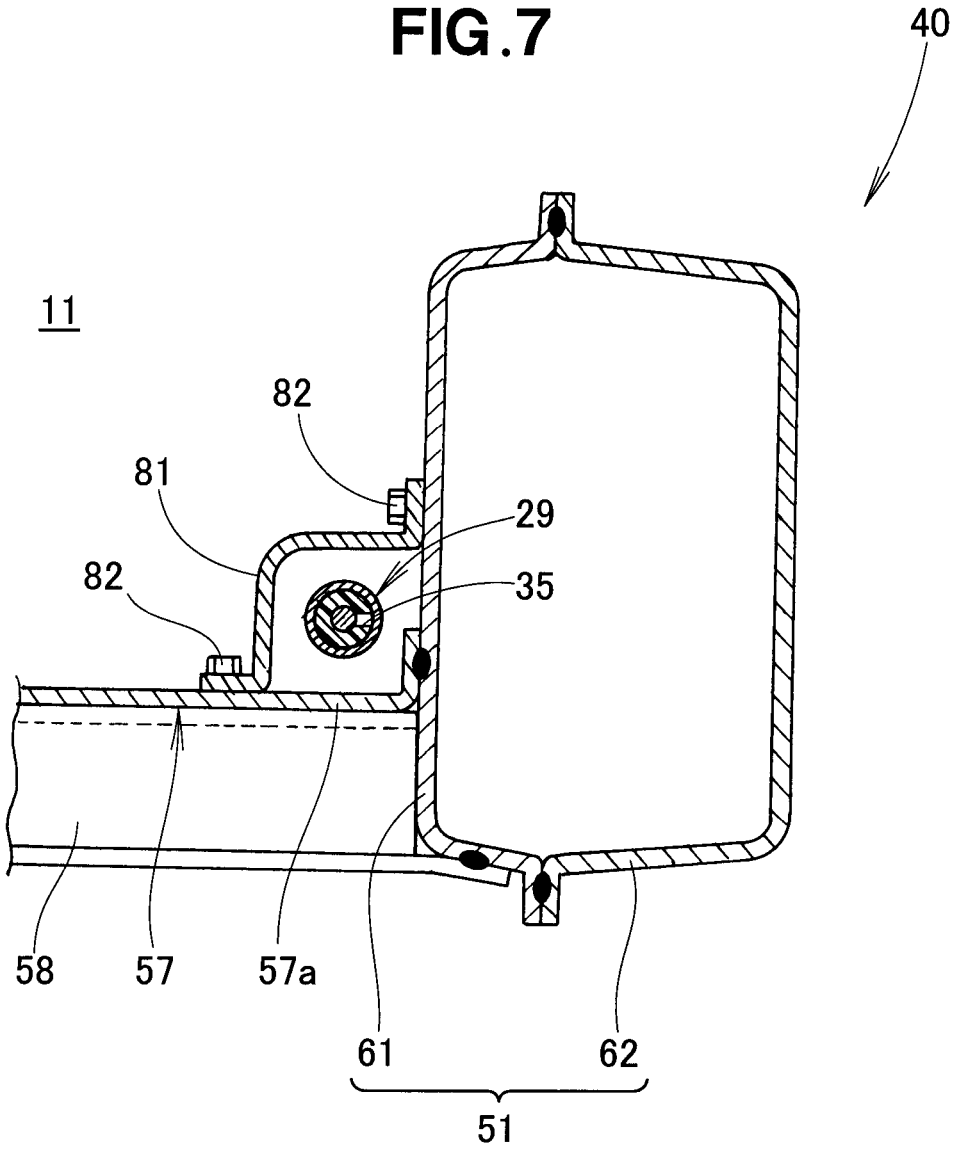
FIG. 7 is a cross-sectional view taken along line 7-7 of FIG. 6.

As illustrated in FIGS. 6 and 7, a part of the plurality of slots 35, which is positioned at the front portion of the vehicle 10 (see FIG. 1), is covered with a grounded (earthed) conductor 81. More specifically, the conductor 81 is formed of conductive material, such as a cover made of metallic plate material, and is electrically connected to the vehicle body 40. The conductor 81 is positioned at, for example, the corner between the side sill 51 and the end portion 57*a* of the floor panel 57, and mounted on the side sill 51 and the floor panel 57 by at least one conductive bolt 82. The side sill 51 and the floor panel 57 are formed of the material having conductivity.

Thus, a part of the plurality of slots 35, which is positioned at the front portion of the vehicle 10, is covered with the grounded (earthed) conductor 81. With this structure, the electric field strength can be homogenized between the front seat 12 side and the rear seat 15 side despite a fact that the connecting end 37 (signal input end 37) of the leaky coaxial cable 29 is positioned at the front portion of the vehicle 10. For example, detection accuracy in the case of detecting the portable terminal device 22 left inside the vehicle interior 11 can be homogenized in the entire vehicle interior 11.

Next, a relation between arrangement of the leaky coaxial cables 29, 29 and the communication area will be described based on the FIGS. 8(*a*), 8(*b*), and 8(*c*). The radio waves transmitted from the leaky coaxial cables 29, 29 have the frequency of the high-frequency zone which is at least 150 MHz.

Figure 8:
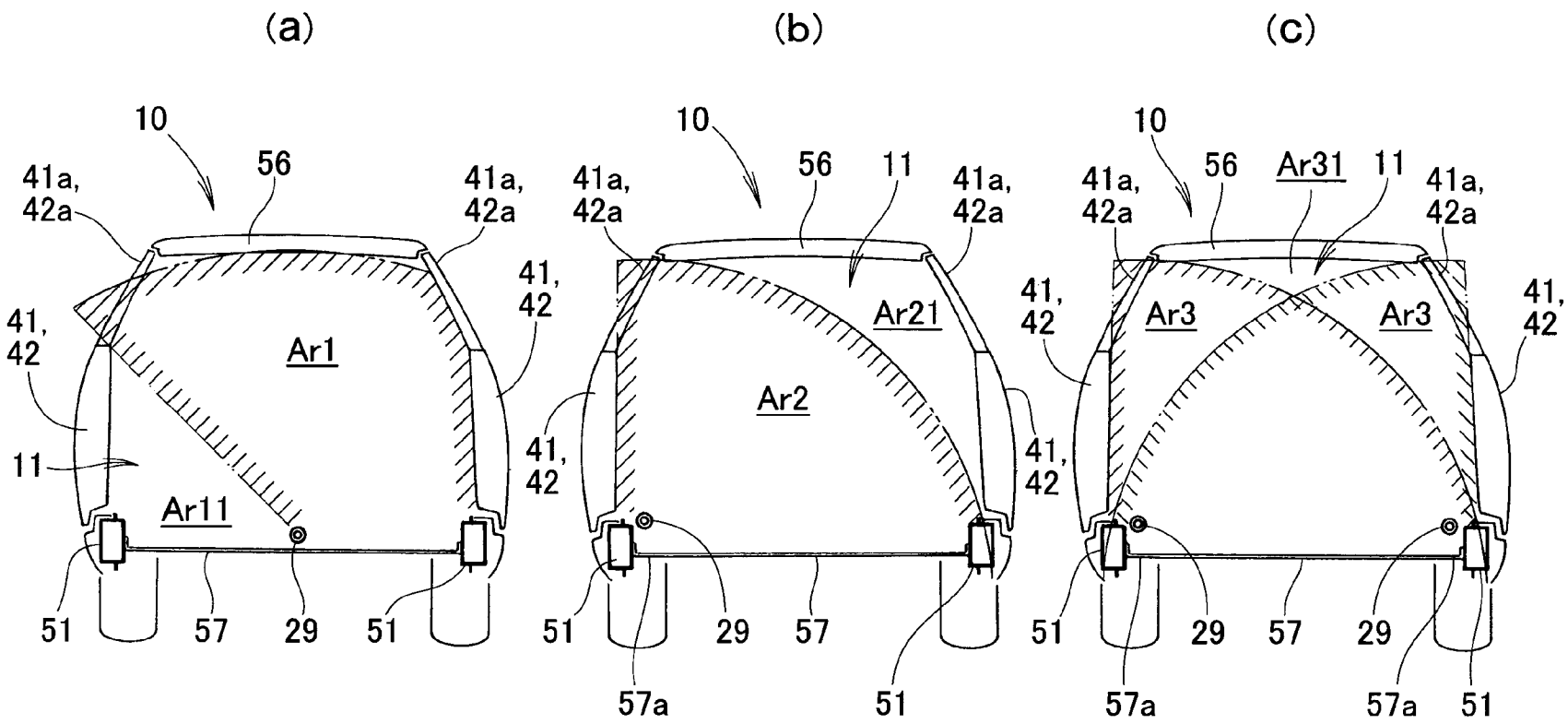
FIGS. 8(*a*) to 8(*c*) are explanatory views explaining a relation between arrangement of the leaky coaxial cable in the vehicle interior and a transmission area of a radio wave transmitted inside the vehicle interior from the leaky coaxial cable illustrated in FIG. 1.

FIG. 8(*a*) is a diagram illustrating a transmission area Ar1 of radio waves transmitted inside the vehicle interior 11 from the leaky coaxial cable 29 in the case where one leaky coaxial cable 29 is arranged at the center of the vehicle width of the vehicle interior 11 and above the floor panel 57. In this case, a part of the radio waves passes through windows 41*a*, 42*a* of the doors 41, 42 from the vehicle interior 11 and substantially leaks outside the vehicle. Also, there is a large area Ar11 where the radio waves transmitted from the leaky coaxial cable 29 cannot reach inside the vehicle interior 11.

FIG. 8(*b*) is a diagram illustrating a transmission area Ar2 of the radio waves transmitted inside the vehicle interior 11 from the leaky coaxial cable 29 in the case where one leaky coaxial cable 29 is arranged at the corner between the left side sill 51 and the left end portion 57*a* of the floor panel 57 inside the vehicle interior 11. In this case, a range in which a part of the radio waves passes through the windows 41*a*, 42*a* of the doors 41, 42 from the vehicle interior 11 and leaks outside the vehicle is small. However, there is a large area Ar21 where the radio waves transmitted from the leaky coaxial cable 29 cannot reach inside the vehicle interior 11.

FIG. 8(*c*) is a diagram illustrating transmission areas Ar3, Ar3 of the radio waves transmitted inside the vehicle interior 11 from the leaky coaxial cables 29, 29 in the case where two leaky coaxial cables 29, 29 are arranged at the respective corners between the right and left side sills 51, 51 and the right and left end portions 57*a*, 57*a* of the floor panel 57 inside the vehicle interior 11. The right and left transmission areas Ar3, Ar3 overlap each other at the center of the vehicle width. Further, an area Ar31 where the radio waves transmitted from the leaky coaxial cable 29, 29 cannot reach is extremely small inside the vehicle interior 11. As a result of the above, it is preferable that the right and left leaky coaxial cables 29, 29 are positioned at the lower left corner and the lower right corner of the vehicle interior 11 as illustrated in FIG. 8(*c*).

Thus, the right and left leaky coaxial cables 29, 29 are positioned at both of the end portions 57*a*, 57*a* in the vehicle width direction above the floor panel 57 at the lower portion of the vehicle interior 11 and on the more inner side in the vehicle width direction than the right and left door inner panels 72, 72. In other words, the right and left leaky coaxial cables 29, 29 are positioned at the lower left corner and the lower right corner of the vehicle interior 11 and extend in the vehicle longitudinal direction. Wall surfaces of the respective lower corner are formed of the material that reflects the electromagnetic wave. When the radio waves of the high-frequency zone transmitted inside the vehicle interior 11 from the left leaky coaxial cables 29, 29 hit the lower right and lower left corners of the vehicle interior 11, the radio waves are reflected by the wall surfaces of the respective lower corners and returned to the inside of the vehicle interior 11. A distance from each of the right and left leaky coaxial cables 29, 29 to each of the windows 41*a*, 42*a* that easily passes the electromagnetic wave is relatively long.

Moreover, the radio waves can be prevented from passing the windows 41*a*, 42*a* and leaking outside the vehicle from the vehicle interior 11 by suitably adjusting transmission output of the radio waves of the high-frequency zone transmitted from the right and left leaky coaxial cables 29, 29 (for example, adjusting by the output adjusters 28, 28). In other words, even in the case of using the radio waves of the high-frequency zone for the vehicle communication apparatus 21, the transmission range of the radio waves can be adjusted so as to be only within the vehicle interior 11 only by adjusting the transmission output of the radio wave. For instance, it is possible to build the vehicle electronic key system 20 using the communication system based on the standards of Bluetooth (registered trademark) or Wi-Fi (registered trademark) loaded on the portable terminal device 22 as standard. Thus, the communication system with higher versatility based on the standards of Bluetooth (registered trademark) or Wi-Fi (registered trademark) adopted as standard in the portable terminal device 22 can be applied to the communication system of the vehicle communication apparatus 21.

Moreover, almost entire range of the vehicle interior 11 can be the transmission areas Ar3, Ar3 of the radio waves because the area Ar31 where the radio waves transmitted from the leaky coaxial cables 29, 29 cannot reach can be minimized inside the vehicle interior 11. Therefore, the vehicle communication apparatus 21 can surely and quickly detects whether the portable terminal device 22 including the function of the electronic key exists inside the vehicle interior 11. For example, in the case of locking the doors 41, 42 by the lock switch while the portable terminal device 22 is left inside the vehicle interior 11, the doors 41, 42 are prevented from being locked with the portable terminal device 22 left inside the vehicle interior 11.

Moreover, using the portable terminal device 22 existing inside the vehicle interior 11, local communication with the control unit 24 can be executed by the radio waves of the high-frequency zone having at least the frequency of 150 MHz. Various kinds of information can be mutually transferred between of the portable terminal device 22 and respective portions in the vehicle 10 via the control unit 24 by the local communication. For instance, various kinds of information of the vehicle 10 are transferred to the portable terminal device 22 and the information is displayed on a display unit of the portable terminal device 22, thereby achieving to provide the information to a passenger.

Next, a concept of the communication area where the respective antennas 26, 27, 29, 29 illustrated in FIG. 1 can individually communicate with the portable terminal device 22 will be described. As illustrated in FIG. 1, the signal distributor 25 sequentially switches a connection route of each of the antennas 26, 27, 29, 29 with respect to the control unit 24 at a predetermined constant "switch time" in accordance with a switch command from the control unit 24. The switch time is very short, for example, tens of milliseconds. The control unit 24 generates a signal having a predetermined frequency (response request signal) every time the connection route is switched, and transmits the signal to one connected antenna out of the respective antennas 26, 27, 29, 29. The respective antennas 26, 27, 29, 29 sequentially transmit radio waves in accordance with the response request signals individually received from the control unit 24.

The portable terminal device 22 transmits, to one (specific antenna) of the respective antennas 26, 27, 29, 29, having transmitted the radio wave of the response request, a response signal (radio wave) in response to the radio wave of the response request in the case where there is any communication area capable of communication. The specific antenna transmits the response signal received from the portable terminal device 22 to the control unit 24 via the signal distributor 25.

In the case of receiving the response signal from the portable terminal device 22 via the specific antenna within a very short constant "response time" from a time point of transmission of the radio wave of the response request, the control unit 24 determines "response is received". In other words, the control unit 24 determines "the portable terminal device 22 exists in the communication area (response area) capable of communicating with the specific antenna".

On the other hand, in the case of not receiving the response signal from the portable terminal device 22 via the specific antenna within the response time, the control unit 24 determines "no response is received". In other words, the control unit 24 determines "the portable terminal device 22 does not exist in the communication area capable of communicating with the specific antenna". Note that the response time is set shorter than the switch time.

Figure 9:
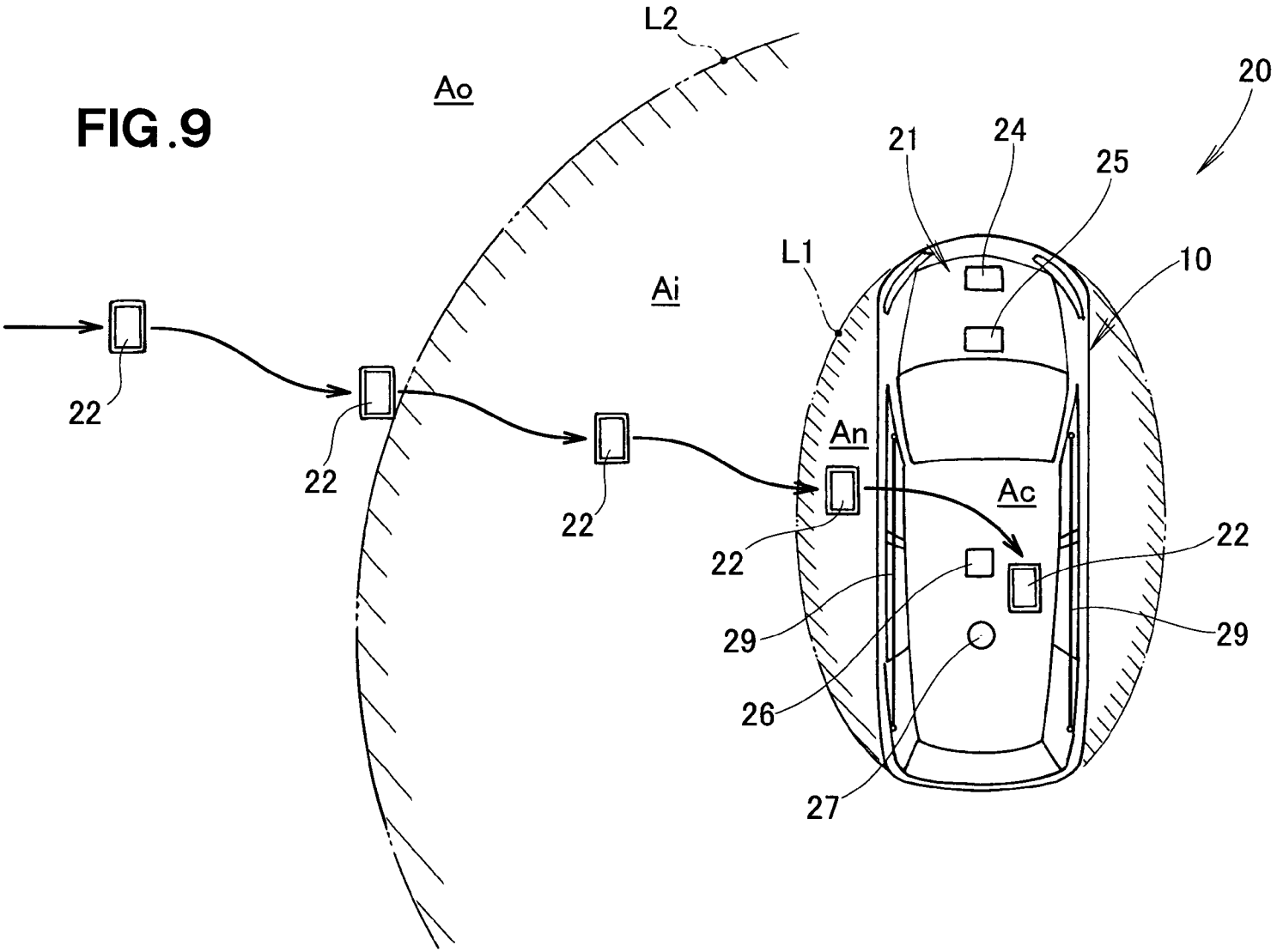
FIG. 9 is an explanatory view for explaining a relation between respective communication areas of respective antennas illustrated in FIG. 1 and a position of a portable terminal device.

As illustrated in FIG. 9, a response area Ac where the radio waves transmitted from the right and left leaky coaxial cables 29, 29 can reach is substantially only inside the vehicle interior 11. The response area Ac is referred to as "area Ac inside the vehicle interior".

A response area An where the radio waves transmitted from the near area antenna 26 can reach is a range from the near area antenna 26 to a vicinity of an outer periphery of the vehicle 10 (first reference line L1). A size of the near area An (vehicle near area An) is, for example, set at about 2-meter range from the periphery of the vehicle 10.

A response area Ai where the radio waves transmitted from the wide area antenna 27 can reach is a range from the wide area antenna 27 to a second reference line L2. The response area Ai (communication service area Ai) circled by the second reference line L2 has a larger range than the near area An of the vehicle.

An area Ao (outside of a communication service area Ao) located more outer-side than the communication service area Ai is an entire range surrounding the second reference line L2.

Table 1 shows a summary of a relation between reception results of the response signals of the portable terminal device 22 received by the respective antennas 26, 27, 29, 29 and the response areas determined by the control unit 24 in accordance with the reception results.

TABLE 1

| DETERMINATION ON RESPONSE AREA | ANTENNA TYPE | | | |
|---|---|---|---|---|
| | WIDE AREA ANTENNA | NEAR AREA ANTENNA | LEFT VEHICLE INTERIOR ANTENNA | RIGHT VEHICLE INTERIOR ANTENNA |
| OUTSIDE OF COMMUNICATION SERVICE AREA Ao | X | X | X | X |
| COMMUNICATION SERVICE AREA Ai | ○ | X | X | X |
| VEHICLE NEAR AREA An | ○ or X | ○ | X | X |
| AREA INSIDE VEHICLE INTERIOR Ac | ○ or X | ○ or X | ○ | ○ or X |
| AREA INSIDE VEHICLE INTERIOR Ac | ○ or X | ○ or X | ○ or X | ○ |

○ RECEIVED
X NOT RECEIVED

As illustrated in Table 1, ○ indicates a case in which the response signal from the portable terminal device 22 is individually received by each of the antennas 26, 27, 29, 29. And, × indicates a case in which the response signal is not received.

As shown in FIG. 9 and Table 1, in the case where all of the antennas 26, 27, 29, 29 do not receive the response signal from the portable terminal device 22, the control unit 24 determines that "portable terminal device 22 exists in the outside of the communication service area Ao".

In the case where the only the wide area antenna 27 receives the response signal from the portable terminal device 22, the control unit 24 determines "the portable terminal device 22 exists in the communication service area Ai".

In the case where the near area antenna 26 receives the response signal from the portable terminal device 22 and the right and left interior antennas 29, 29 do not receive the same, the control unit 24 determines "the portable terminal device 22 exists in the vehicle near area An". In this case, whether the wide area antenna 27 received the response signal has no relation.

In the case where the left interior antenna 29 receives the response signal from the portable terminal device 22, the control unit 24 determines "the portable terminal device 22 exists in the area inside the vehicle interior Ac". In this case, whether the near area antenna 26, wide area antenna 27, and right interior antenna 29 received the response signal has no relation.

In the case where the right interior antenna 29 receives the response signal from the portable terminal device 22, the control unit 24 determines "portable terminal device 22 exists in the area inside the vehicle interior Ac". In this case, whether the near area antenna 26, wide area antenna 27, and left interior antenna 29 received the response signal has no relation.

Second Embodiment

Figure 10:
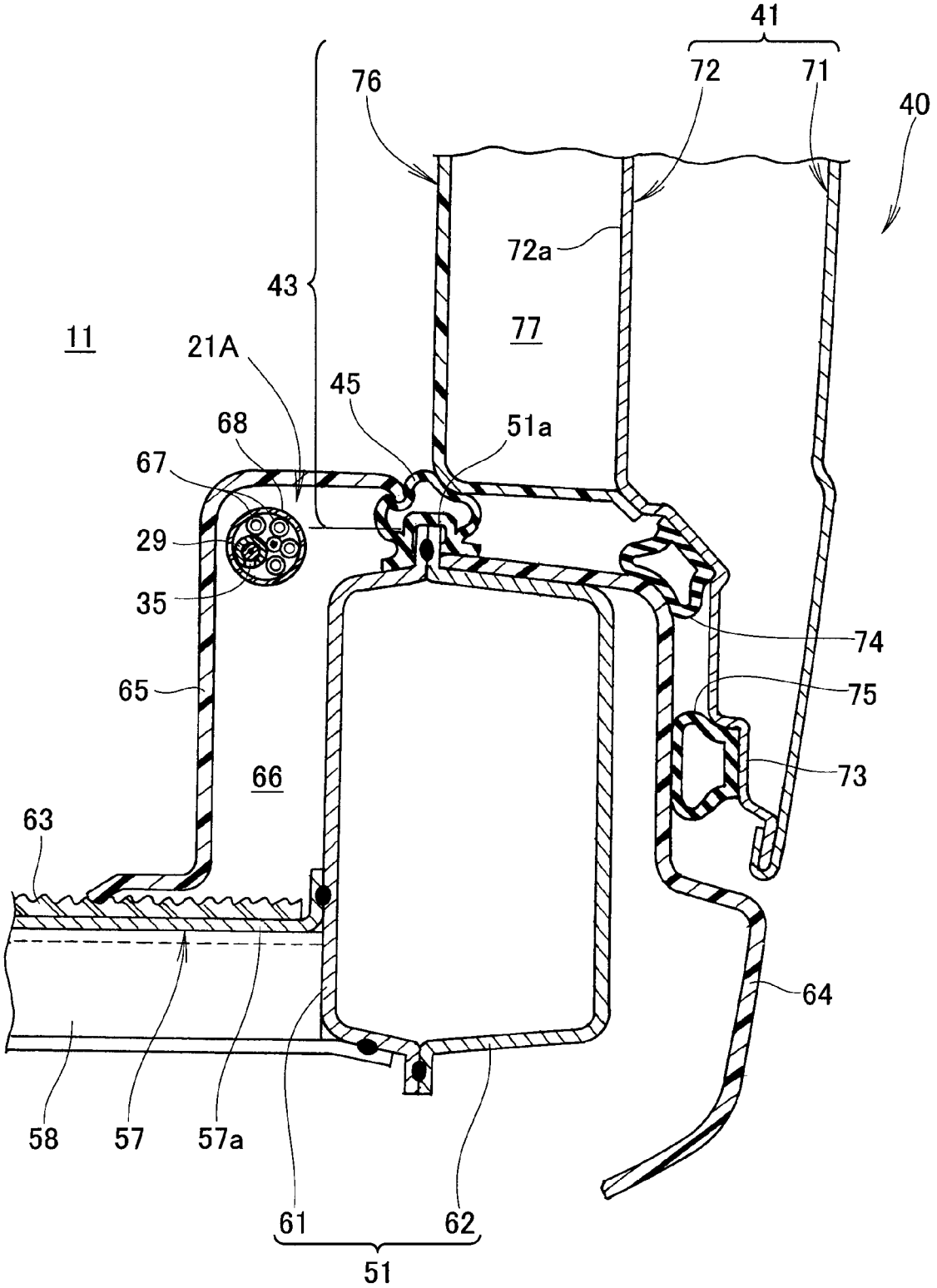
FIG. 10 is an explanatory view for explaining an arrangement structure of a leaky coaxial cable of a vehicle communication apparatus according to a second embodiment of the present invention.
Figure 11:
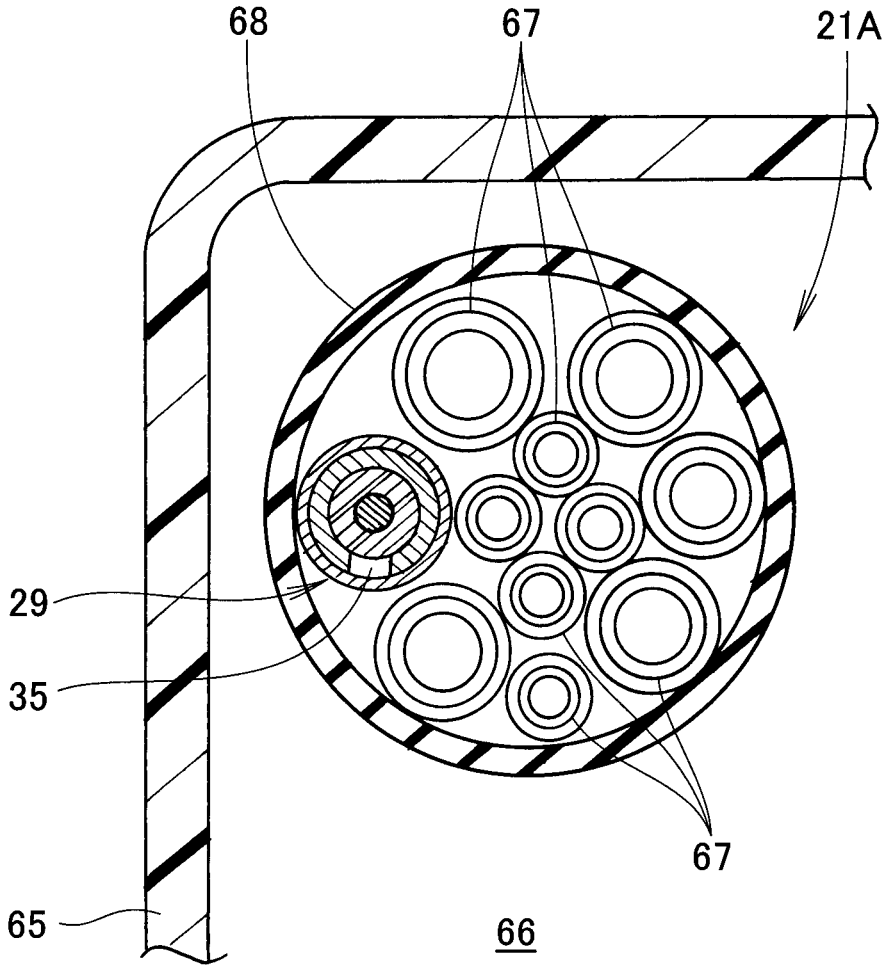
FIG. 11 is a cross-sectional view illustrating an enlarged leaky coaxial cable illustrated in FIG. 10.

An antenna arrangement structure for a vehicle communication apparatus according to a second embodiment will be described based on FIGS. 10 and 11. FIG. 10 is a diagram corresponding to above-described FIG. 4. A vehicle communication apparatus 21A according to the second embodiment is characterized in having a modified arrangement structure of right and left interior antennas 29, 29 (right and left leaky coaxial cables 29, 29) according to a first embodiment illustrated in FIGS. 1 to 9 to an arrangement structure illustrated in FIGS. 10 and 11, and a description for other structures will be omitted for being same as the first embodiment illustrated in FIGS. 1 to 9.

In the following, the arrangement structure of the right interior antenna 29 (right leaky coaxial cable 29) will be described. A description for the arrangement structure of the left interior antenna 29 (left leaky coaxial cable 29) will be omitted for having the same structure as the arrangement structure of the right interior antenna 29 except for being bilaterally symmetric.

More specifically, in the vehicle communication apparatus 21A, a right leaky coaxial cable 29 is passed through a right corrugated tube 68 (protection tube 68) together with a plurality of wire harnesses 67 connected to an on-vehicle device. The right corrugated tube 68 is extended inside a first space section 66 in a longitudinal direction of a vehicle body by being covered with a right side sill cover 65.

Thus, the right leaky coaxial cable 29 and the right corrugated tube 68 are positioned in a vicinity of an upper portion of a right side sill 51 inside the first space section 66. In other words, the right leaky coaxial cable 29 is positioned, on a more inner side in the vehicle width direction than a right door inner panel 72, at a lower portion of a vehicle interior 11 and at an end portion 57*a* in a vehicle width direction above a floor panel 57, and further extends in a vehicle longitudinal direction.

The right leaky coaxial cable 29 is positioned closer to the vehicle interior 11 side than the plurality of wire harnesses 67 inside the right corrugated tubes 68. A plurality of slots 35 provided at the leaky coaxial cable 29 is oriented in a vehicle outside direction which is an opposite direction of the vehicle interior 11. For example, the plurality of slots 35 is oriented to both end portions 57*a* in the vehicle width direction of the floor panel 57 or the right side sill 51.

According to the second embodiment, functions and effects same as the first embodiment are exerted. Further, according to the second embodiment, the right and left leaky coaxial cables 29 are passed inside the right and left corrugated tubes 68, effectively utilizing the right and left corrugated tubes 68 where the plurality of wire harnesses 67 is passed. With this structure, the right and left leaky coaxial cables 29 can be protected without using any new protection member. Moreover, generation of friction and abnormal sound caused by the right and left leaky coaxial cables 29 contacting other members due to vibration of a vehicle 10 can be prevented.

Furthermore, according to the second embodiment, the right and left leaky coaxial cables 29 are positioned closer to the vehicle interior 11 side than the plurality of wire harnesses 67 inside the right and left corrugated tubes 68. Therefore, desired communication performance can be obtained without a signal being interrupted by the wire harnesses 67 despite a fact that the right and left corrugated tubes 68 are passed through the right and left corrugated tubes 68 together with the plurality of wire harnesses 67.

Third Embodiment

Figure 12:
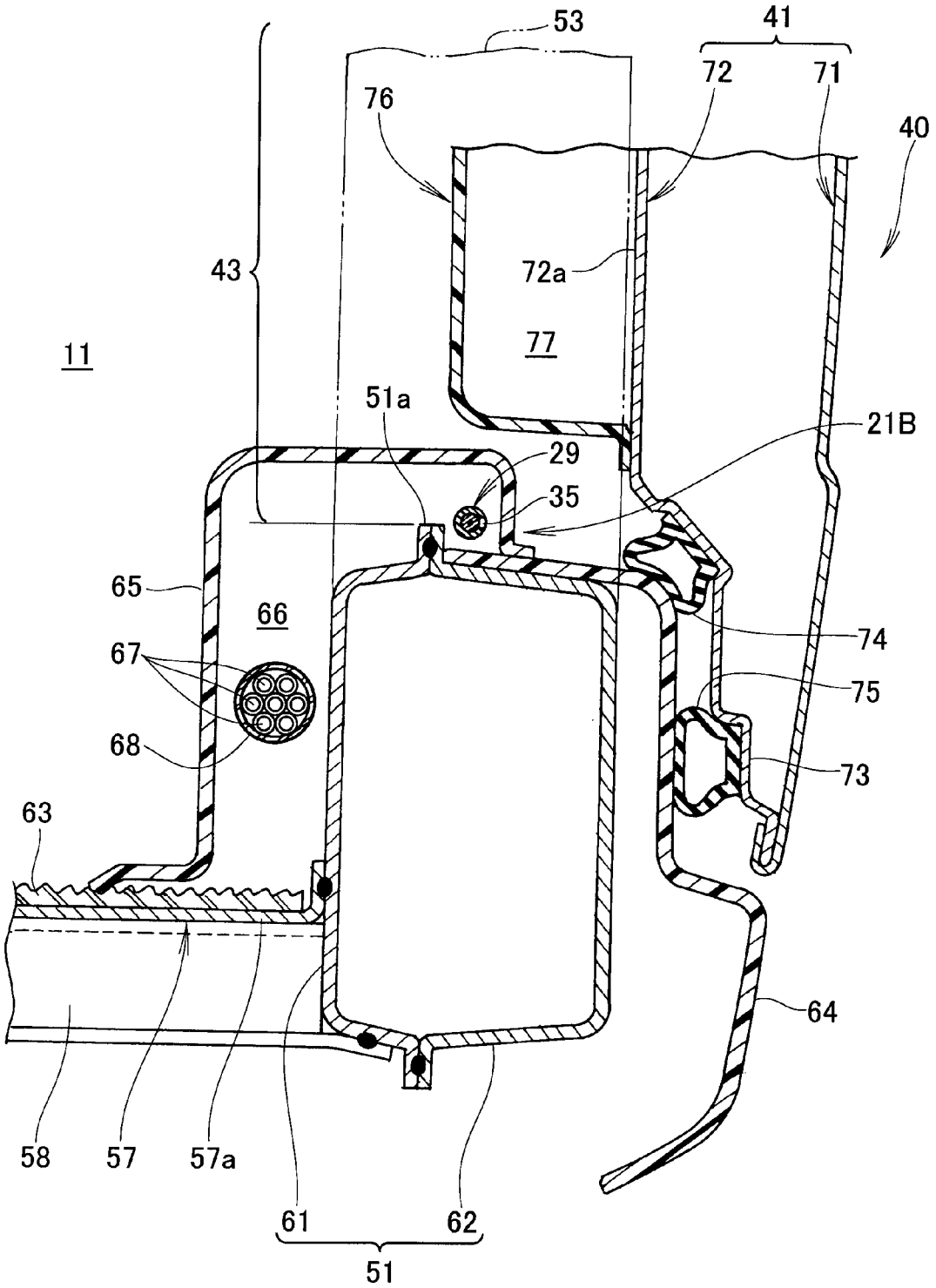
FIG. 12 is an explanatory view for explaining an arrangement structure of a leaky coaxial cable of a vehicle communication apparatus according to a third embodiment of the present invention.
Figure 13:
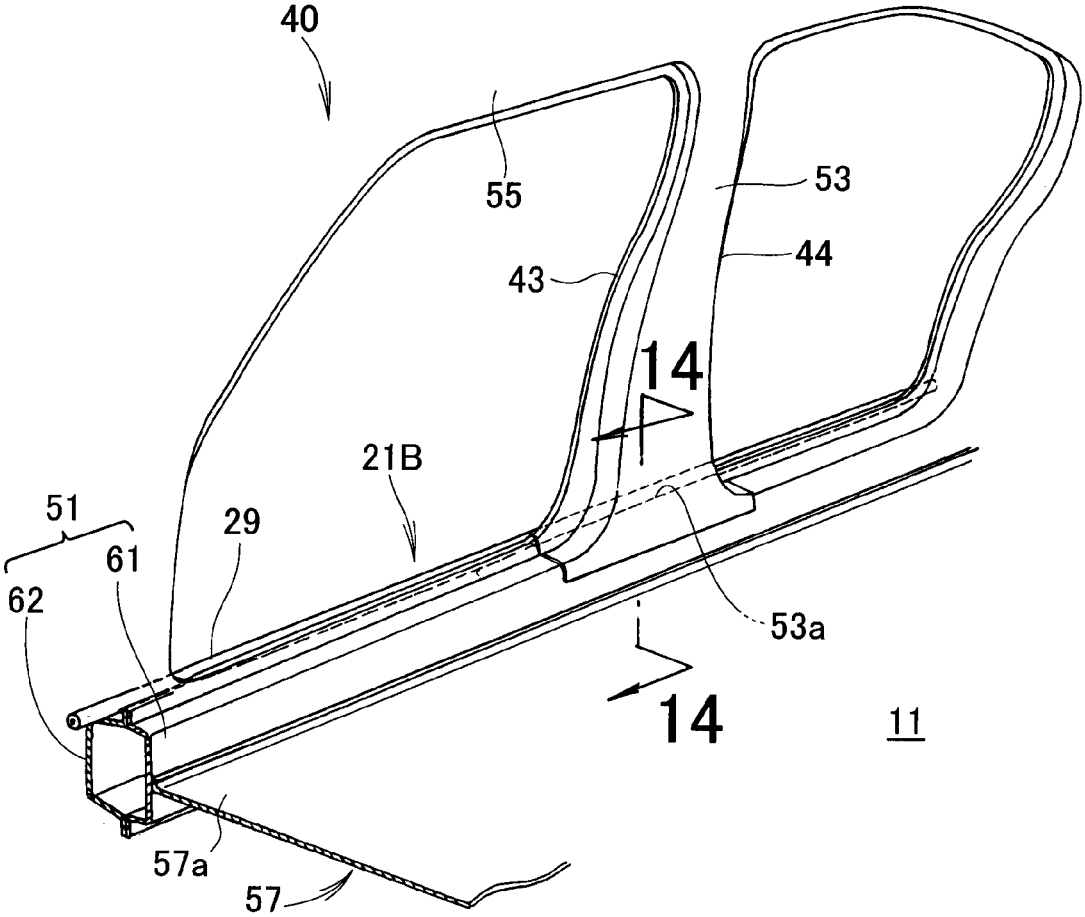
FIG. 13 is a perspective view from a vehicle interior, illustrating a structure in which the leaky coaxial cable illustrated in FIG. 12 is passed inside the vehicle interior.
Figure 14:
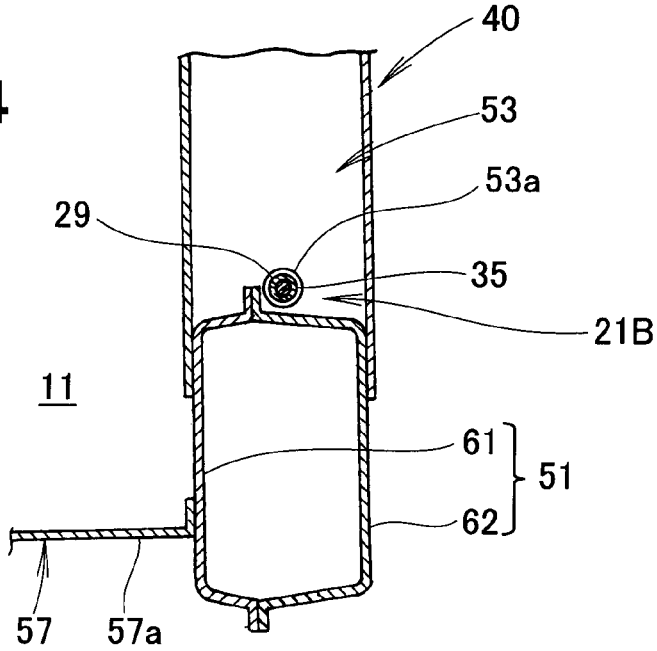
FIG. 14 is a cross-sectional view taken along line 14-14 of FIG. 13.

An antenna arrangement structure for a vehicle communication apparatus according to a third embodiment will be described based on FIGS. 12 to 14. FIG. 12 is a diagram corresponding to above-described FIG. 4. A vehicle communication apparatus 21B according to the third embodiment is characterized in having a modified arrangement structure of right and left interior antennas 29, 29 according to a first embodiment illustrated in FIGS. 1 to 9 to an arrangement structure illustrated in FIGS. 12 to 14, and a description for other structures will be omitted for being same as the first embodiment illustrated in FIGS. 1 to 9.

In the following, the arrangement structure of the right interior antenna 29 (right leaky coaxial cable 29) will be described. A description for the arrangement structure of the left interior antenna 29 (left leaky coaxial cable 29) will be omitted for having the same structure as the arrangement structure of the right interior antenna 29 except for being bilaterally symmetric.

More specifically, the right leaky coaxial cable 29 of a vehicle communication apparatus 21B extends in a longitudinal direction of the vehicle body above a right side sill 51 and also piece a right center pillar 53 in a longitudinal direction of the vehicle body. In other words, the right center pillar 53 is formed with a piercing hole 53*a* pierced through in the longitudinal direction. The right leaky coaxial cable 29 is passed through the piercing hole 53*a*.

Further, at a front door opening 43 and a rear door opening 44, a right corrugated tube 68 is extended inside a first space section 66 in a longitudinal direction of the vehicle body by being covered with a right side sill cover 65 (see FIG. 12).

Thus, the right leaky coaxial cable 29 is positioned, on a more inner side in a vehicle width direction than the right door inner panel 72, at a lower portion of a vehicle interior 11 and above a right side sill 51, and further extends in a vehicle longitudinal direction.

A plurality of slots 35 provided at the leaky coaxial cable 29 is oriented in a vehicle outside direction which is an opposite direction of the vehicle interior 11. For example, the plurality of slots 35 is oriented to the center pillar 53 and door inner panel 72, or side sill 51.

According to the third embodiment, functions and effects same as the first embodiment are exerted. Further, according to the third embodiment, preferably, the right and left leaky coaxial cables 29 are passed inside the right and left corrugated tubes 68, effectively utilizing the right and left corrugated tubes 68 where a plurality of wire harnesses 67 is passed same as a second embodiment. Additionally, it is preferable that the right leaky coaxial cables 29 are positioned closer to a vehicle interior 11 side than the plurality of wire harnesses 67 inside the right corrugated tubes 68. With this structure, functions and effects same as the above second embodiment are exerted.

Moreover, according to the third embodiment, the right and left leaky coaxial cables 29 pierce the right and left center pillars 53 in the longitudinal direction of the vehicle body. Therefore, the right and left leaky coaxial cables 29 can be linearly extended from a front portion to a rear portion of the vehicle interior 11 without bypassing the right and left center pillars 53. Also, the right and left leaky coaxial cables 29 are not needed to be divided in the longitudinal direction of the vehicle interior 11.

Fourth Embodiment

Figure 15:
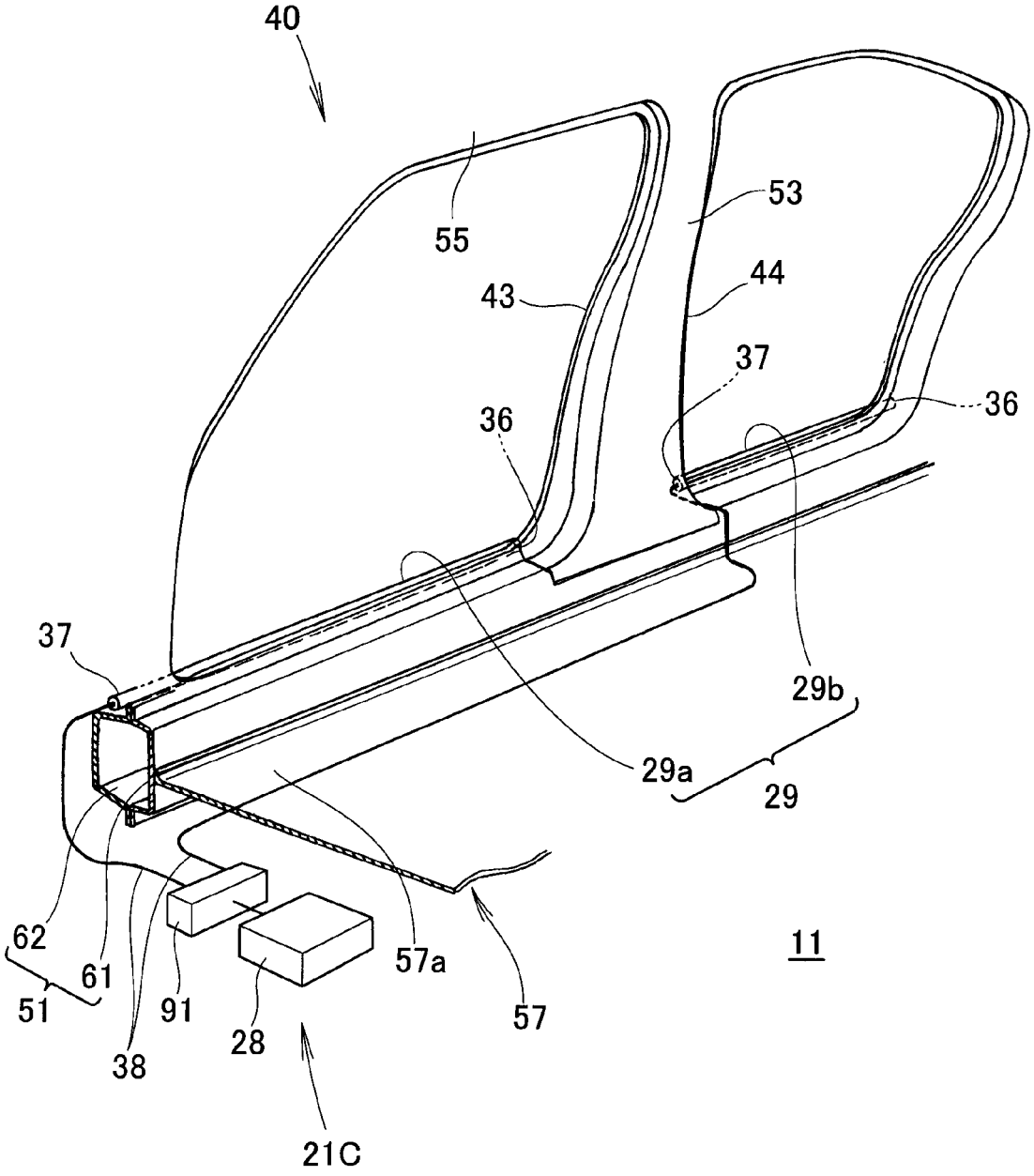
FIG. 15 is an explanatory view for explaining an arrangement structure of a leaky coaxial cable of a vehicle communication apparatus according to a fourth embodiment of the present invention.

An antenna arrangement structure for a vehicle communication apparatus according to a fourth embodiment will be described based on FIG. 15. FIG. 15 is a diagram corresponding to above-described FIG. 13. A vehicle communication apparatus 21C according to a fourth embodiment is characterized in having a modified arrangement structure of right and left interior antennas 29 (right and left leaky coaxial cables 29) according to a third embodiment illustrated in FIGS. 12 to 14 to an arrangement structure illustrated in FIG. 15, and a description for other structures will be omitted for being same as the first to third embodiments.

In the following, the arrangement structure of the right interior antenna 29 (right leaky coaxial cable 29) will be described. A description for the arrangement structure of the left interior antenna 29 (left leaky coaxial cable 29) will be omitted for having the same structure as the arrangement structure of the right interior antenna 29 except for being bilaterally symmetric.

More specifically, the right leaky coaxial cable 29 of the vehicle communication apparatus 21C is positioned at least from a front end to a rear end of a lower edge in each of right and left door openings 43 on a front side, and also positioned at least from a front end to a rear end of the lower edge in each of right and left rear-side door openings 44. Further, the right leaky coaxial cable 29 extends in a longitudinal direction of the vehicle body.

In other words, the right leaky coaxial cable 29 is divided into two portions: a portion on a front-side door opening 43; and a portion on right and left rear-side door openings 44. More specifically, the right leaky coaxial cable 29 is formed of the front-side leaky coaxial cable 29*a* and the rear-side leaky coaxial cable 29*b*. The front-side leaky coaxial cable 29*a* and the rear-side leaky coaxial cable 29*b* have the same structure, and terminating resistors 36, 36 are disposed at respective rear ends thereof. A connecting end 37 at a front end of the front-side leaky coaxial cable 29*a* and a connecting end 37 at a front end of the rear-side leaky coaxial cable 29*b* are connected to an output adjuster 28 via a signal distributor 91. The signal distributor 91 simultaneously connects the front-side and rear-side leaky coaxial cables 29*a*, 29*b* to a control unit 24. A signal from a control unit 24 (see FIG. 1) is simultaneously transmitted to the front-side and rear-side leaky coaxial cables 29*a*, 29*b* from the signal distributor 91 via the output adjuster 28. Note that whether to provide the signal distributor 91 is optional. In the case of not providing the signal distributor 91, the signal is simultaneously transmitted from the control unit 24 to the front-side and rear-side leaky coaxial cables 29*a*, 29*b*.

A plurality of slots 35 (see FIG. 14) provided at the right and left leaky coaxial cables 29 are oriented in a vehicle outside direction which is an opposite direction of the vehicle interior 11. For example, the plurality of slots 35 is oriented to a door inner panel 72 or a side sill 51.

According to the fourth embodiment, functions and effects same as the first to third embodiments are exerted. Further, according to the fourth embodiment, the right and left leaky coaxial cables 29 are passed through by effectively utilizing a space at the lower edges of the respective door openings 43, 44, and therefore, it is not necessary to provide any new space in the vehicle interior 11 in order to pass the leaky coaxial cables 29. Therefore, the space equal to the related art can be secured in the vehicle interior 11.

Fifth Embodiment

Figure 16:
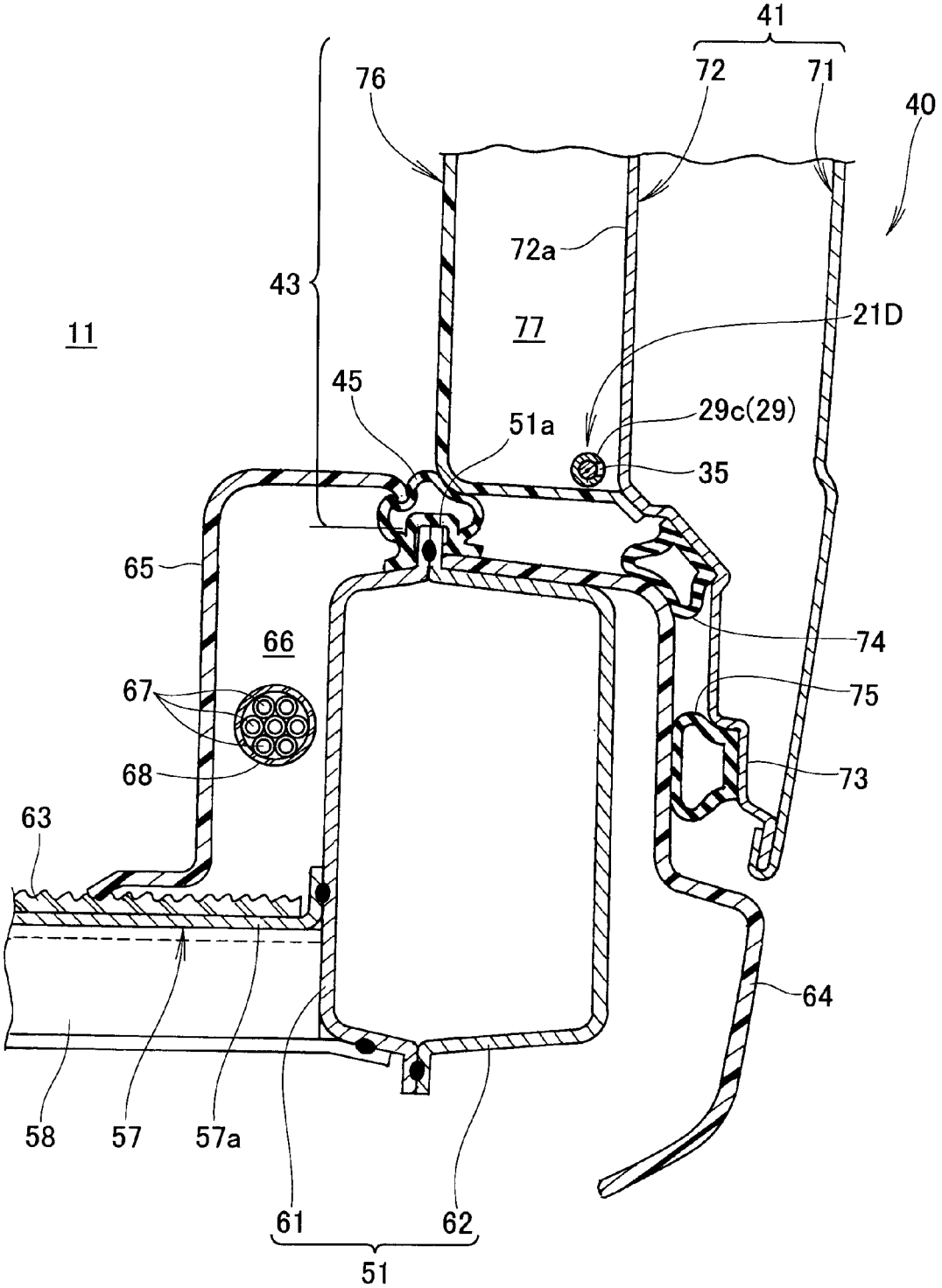
FIG. 16 is an explanatory view for explaining an arrangement structure of a leaky coaxial cable of a vehicle communication apparatus according to a fifth embodiment of the present invention.
Figure 17:
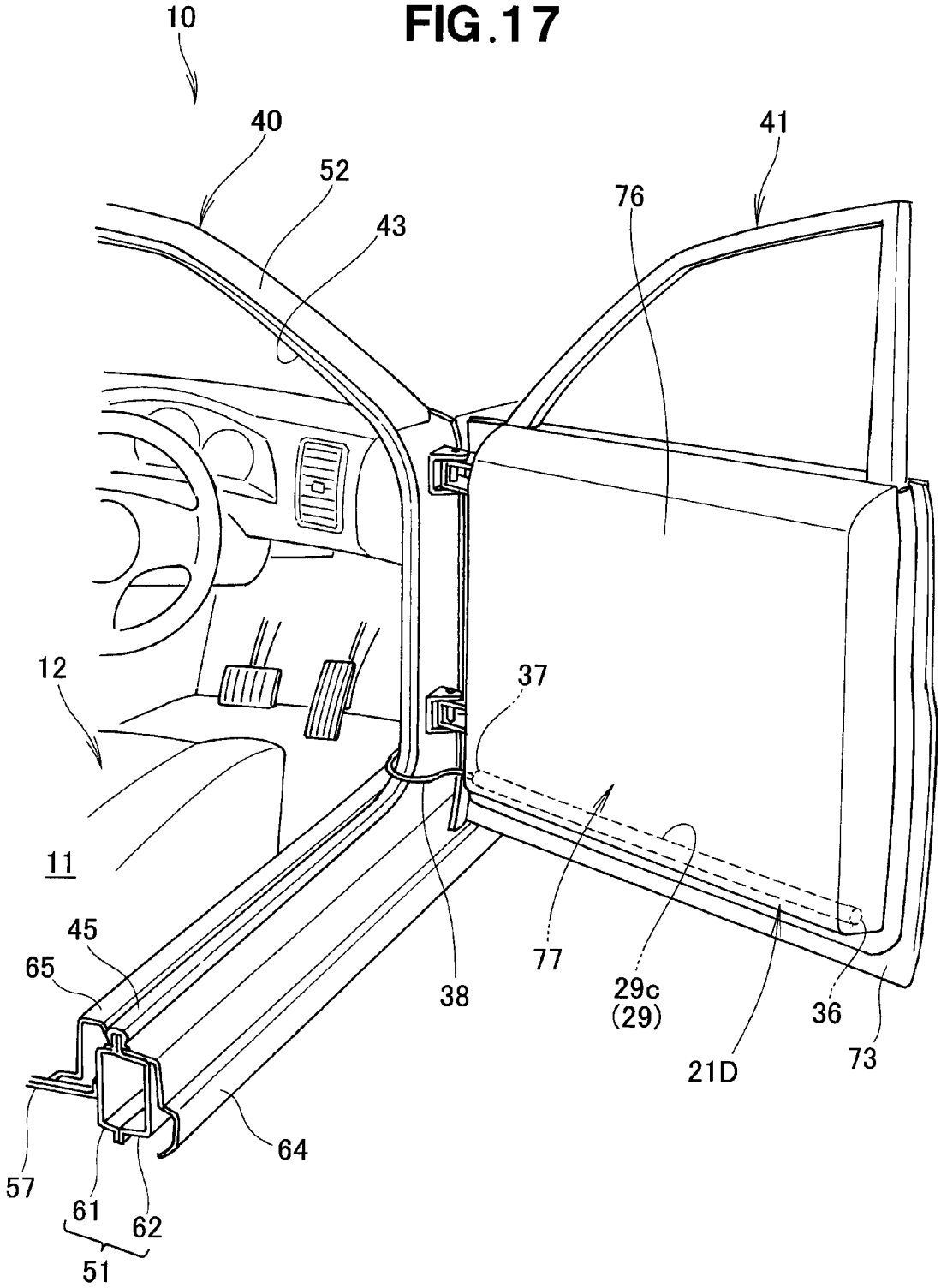
FIG. 17 is a perspective view illustrating a structure in which the leaky coaxial cable illustrated in FIG. 16 is arranged at a front door.
Figure 18:
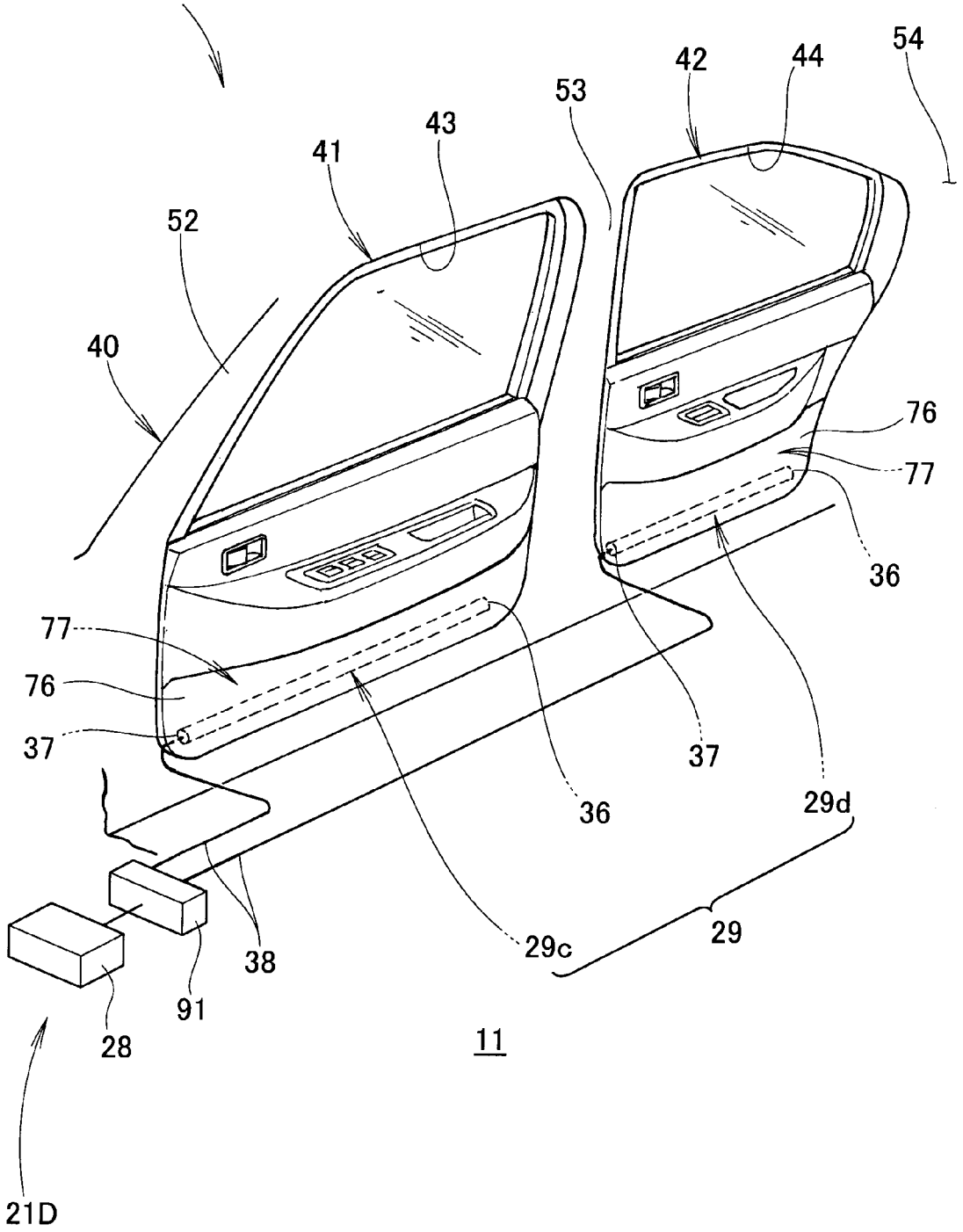
FIG. 18 is a perspective view from a vehicle interior, illustrating a structure in which the leaky coaxial cable illustrated in FIG. 16 is arranged at the front door and a rear door.

An antenna arrangement structure for a vehicle communication apparatus according to a fifth embodiment will be described based on FIGS. 16 to 18. FIG. 16 is a diagram corresponding to above-described FIG. 4. A vehicle communication apparatus 21D according to the fifth embodiment is characterized in having a modified arrangement structure of right and left interior antennas 29, 29 (right and left leaky coaxial cables 29, 29) according to a first embodiment illustrated in FIGS. 1 to 9 to an arrangement structure illustrated in FIGS. 16 to 18, and a description for other structures will be omitted for being same as the first to third embodiments.

In the following, the arrangement structure of the right interior antenna 29 (right leaky coaxial cable 29) will be described. A description for the arrangement structure of the left interior antenna 29 (left leaky coaxial cable 29) will be omitted for having the same structure as the arrangement structure of the right interior antenna 29 except for being bilaterally symmetric.

More specifically, the right leaky coaxial cable 29 of the vehicle communication apparatus 21D is positioned at least at a lower portion inside a second space section 77. As described above, the second space section 77 is a space surrounded by a door inner panel 72 and a door lining 76. Thus, the right leaky coaxial cable 29 is positioned, on a more inner side in a vehicle width direction than the right door inner panel 72, at a lower portion of a vehicle interior 11 and above a right side sill 51, and further extends in a vehicle longitudinal direction.

In other words, the right leaky coaxial cable 29 is divided into at least two portions: a portion inside the second space section 77 of a front door 41 and a portion inside the second space section 77 of a rear door 42. More specifically, the right leaky coaxial cable 29 is formed of a front-side leaky coaxial cable 29*c* positioned at the front door 41 and a rear-side leaky coaxial cable 29*d* positioned at the rear door 42.

The front-side leaky coaxial cable 29*c* and the rear-side leaky coaxial cable 29*d* have the same structure, and terminating resistors 36, 36 are disposed at respective rear ends of thereof. A connecting end 37 at a front end of the front-side leaky coaxial cable 29*c* and a connecting end 37 at a front end of the rear-side leaky coaxial cable 29*d* are connected to an output adjuster 28 via a signal distributor 91. The signal distributor 91 simultaneously connects the front-side and rear-side leaky coaxial cables 29*c*, 29*d* to a control unit 24. A signal from a control unit 24 (see FIG. 1) is simultaneously transmitted to the front-side and rear-side leaky coaxial cables 29*c*, 29*d* from the signal distributor 91 via an output adjuster 28. Note that whether to provide the signal distributor 91 is optional. In the case of not providing the signal distributor 91, a signal is simultaneously transmitted from the control unit 24 to the front-side and rear-side leaky coaxial cables 29*c*, 29*d*.

A plurality of slots 35 provided at the leaky coaxial cable 29 is oriented in a vehicle outside direction which is an opposite direction of the vehicle interior 11. For example, the plurality of slots 35 is oriented to the door inner panel 72 or side sill 51.

According to the fifth embodiment, functions and effects same as the first to third embodiments are exerted. Further, according to the fifth embodiment, the right leaky coaxial cable 29 is passed through by effectively utilizing the space (second space section 77) between the right door inner panel 72 and the right door lining 76, and therefore, it is not necessary to provide any new space in the vehicle interior 11 in order to pass the leaky coaxial cable 29. Therefore, the space equal to the related art can be secured in the vehicle interior 11.

Note that, according to the antenna arrangement structure of the present invention, the same effects can be provided even in the case where communication is executed by using the right and left leaky coaxial cables 29, 29 with a radio wave of the high-frequency zone having the frequency of 315 MHz generally adopted in a smart entry system.

INDUSTRIAL APPLICABILITY

The antenna arrangement structure for the vehicle communication apparatus 21 according to the present invention is suitable for being adopted in the vehicle electronic key system.

REFERENCE SIGNS LIST

10 Vehicle
11 Vehicle interior
20 Vehicle electronic key system
21, 21A, 21B, 21C, 21D Vehicle communication apparatus
22 Portable terminal device
24 Signal generator (control unit)
29 Interior antenna (right and left leaky coaxial cables)

35 Slot
37 Connecting end
40 Vehicle body
41 Door (front door)
42 Door (rear door)
43 Door opening
44 Door opening
51 Side sill
53 Center pillar
53*a* Piercing hole
57 Floor panel
57*a* End portion
65 Side sill cover
67 Wire harness
68 Corrugated tube
72 Door inner panel
76 Door lining
81 Conductor (cover)

The invention claimed is:

1. An antenna arrangement structure for a vehicle communication apparatus, in which interior antennas are arranged inside a vehicle interior surrounded by a vehicle body including right and left side sills formed of material reflecting an electromagnetic wave and extending in a longitudinal direction of the vehicle body, a floor panel laid between the right and left side sills, and respective door inner panels of right and left doors positioned in a vicinity of the right and left side sills, and the interior antennas can communicate with a portable terminal device existing inside the vehicle interior over radio, wherein the interior antennas include right and left leaky coaxial cables capable of transmitting, to inside of the vehicle interior, a radio wave of a high-frequency zone having a frequency of 150 MHz or higher generated by a signal generator, and the right and left leaky coaxial cables are positioned, on a more inner side in a vehicle width direction than the right and left door inner panels, either at a lower portion of the vehicle interior and above the right and left side sills or at the lower portion of the vehicle interior and above both end portions in the vehicle width direction of the floor panel, and extend in a vehicle longitudinal direction, wherein the right and left leaky coaxial cables are covered with right and left side sill covers to cover at least a part of the right and left side sills and the floor panel.

2. The antenna arrangement structure for a vehicle communication apparatus according to claim 1, further comprising right and left corrugated tubes covered with the right and left side sill covers, wherein in the right and left corrugated tubes, the right and left leaky coaxial cables are passed through together with a wire harness connected to an on-vehicle device, and the right and left leaky coaxial cables are positioned closer to the vehicle interior side than the wire harness is, inside the right and left corrugated tubes.

3. The antenna arrangement structure for a vehicle communication apparatus according to claim 1, wherein connecting ends of the right and left leaky coaxial cables, configured to be connected to the signal generator, are positioned at a front portion of a vehicle.

4. The antenna arrangement structure for a vehicle communication apparatus according to claim 1, wherein the right and left leaky coaxial cables pierce right and left center pillar erected from an approximately center in the longitudinal direction of the vehicle body of the right and left side sills.

5. The antenna arrangement structure for a vehicle communication apparatus according to claim 1, wherein the right and left leaky coaxial cables are positioned to stretch at least from front ends to rear ends of lower edges in respective right and left door openings configured to be opened and closed by the right and left doors.

6. An antenna arrangement structure for a vehicle communication apparatus, in which interior antennas are arranged inside a vehicle interior surrounded by a vehicle body including right and left side sills formed of material reflecting an electromagnetic wave and extending in a longitudinal direction of the vehicle body, a floor panel laid between the right and left side sills, and respective door inner panels of right and left doors positioned in a vicinity of the right and left side sills, and the interior antennas can communicate with a portable terminal device existing inside the vehicle interior over radio, wherein the interior antennas include right and left leaky coaxial cables capable of transmitting, to inside of the vehicle interior, a radio wave of a high-frequency zone having a frequency of 150 MHz or higher generated by a signal generator, and the right and left leaky coaxial cables are positioned, on a more inner side in a vehicle width direction than the right and left door inner panels, either at a lower portion of the vehicle interior and above the right and left side sills or at the lower portion of the vehicle interior and above both end portions in the vehicle width direction of the floor panel, and extend in a vehicle longitudinal direction, wherein the right and left leaky coaxial cables include a plurality of slots configured to pass the radio wave, and the plurality of slots is oriented in a vehicle outside direction which is an opposite direction of the vehicle interior.

7. The antenna arrangement structure for a vehicle communication apparatus according to claim 6, wherein a part of the plurality of slots, positioned at the front portion of the vehicle, is covered with a grounded conductor.

8. The antenna arrangement structure for a vehicle communication apparatus according to claim 6, further comprising right and left corrugated tubes covered with the right and left side sill covers, wherein in the right and left corrugated tubes, the right and left leaky coaxial cables are passed through together with a wire harness connected to an on-vehicle device, and the right and left leaky coaxial cables are positioned closer to the vehicle interior side than the wire harness is, inside the right and left corrugated tubes.

9. The antenna arrangement structure for a vehicle communication apparatus according to claim 6, wherein connecting ends of the right and left leaky coaxial cables, configured to be connected to the signal generator, are positioned at a front portion of a vehicle.

10. The antenna arrangement structure for a vehicle communication apparatus according to claim 6, wherein the right and left leaky coaxial cables pierce right and left center pillar erected from an approximately center in the longitudinal direction of the vehicle body of the right and left side sills.

11. The antenna arrangement structure for a vehicle communication apparatus according to claim 6, wherein the right and left leaky coaxial cables are positioned to stretch at least from front ends to rear ends of lower edges in respective right and left door openings configured to be opened and closed by the right and left doors.

12. An antenna arrangement structure for a vehicle communication apparatus, in which interior antennas are arranged inside a vehicle interior surrounded by a vehicle body including right and left side sills formed of material reflecting an electromagnetic wave and extending in a longitudinal direction of the vehicle body, a floor panel laid between the right and left side sills, and respective door inner panels of right and left doors positioned in a vicinity of the right and left side sills, and the interior antennas can communicate with a portable terminal device existing inside the vehicle interior over radio, wherein the interior antennas include right and left leaky coaxial cables capable of transmitting, to inside of the vehicle interior, a radio wave of a high-frequency zone having a frequency of 150 MHz or higher generated by a signal generator, and the right and left leaky coaxial cables are positioned, on a more inner side in a vehicle width direction than the right and left door inner panels, either at a lower portion of the vehicle interior and above the right and left side sills or at the lower portion of the vehicle interior and above both end portions in the vehicle width direction of the floor panel, and extend in a vehicle longitudinal direction, wherein the right and left leaky coaxial cables are positioned at least between the right and left door inner panels and right and left door linings coating inner surfaces in the vehicle width direction of the right and left door inner panels.

* * * * *